US011053903B2

(12) United States Patent
Kodama et al.

(10) Patent No.: US 11,053,903 B2
(45) Date of Patent: Jul. 6, 2021

(54) HIGH-PRESSURE FUEL SUPPLY PUMP

(71) Applicant: Hitachi Automotive Systems, Ltd., Hitachinaka (JP)

(72) Inventors: Yuitsu Kodama, Hitachinaka (JP); Yuuki Takahashi, Hitachinaka (JP); Yukihiro Yoshinari, Hitachinaka (JP); Ryo Kusakabe, Tokyo (JP)

(73) Assignee: Hitachi Automotive Systems, Ltd., Hitachinaka (JP)

( * ) Notice: Subject to any disclaimer, the term of this patent is extended or adjusted under 35 U.S.C. 154(b) by 0 days.

(21) Appl. No.: 16/622,389

(22) PCT Filed: May 22, 2018

(86) PCT No.: PCT/JP2018/019582
§ 371 (c)(1),
(2) Date: Dec. 13, 2019

(87) PCT Pub. No.: WO2019/003719
PCT Pub. Date: Jan. 3, 2019

(65) Prior Publication Data

US 2020/0182210 A1 Jun. 11, 2020

(30) Foreign Application Priority Data

Jun. 27, 2017 (JP) ..... JP2017-124918

(51) Int. Cl.
*F02M 59/46* (2006.01)
*F02M 59/36* (2006.01)

(52) U.S. Cl.
CPC ..... *F02M 59/466* (2013.01); *F02M 59/366* (2013.01)

(58) Field of Classification Search
CPC .... F02M 59/466; F02M 59/366; F02M 59/36; F02M 59/46
See application file for complete search history.

(56) References Cited

U.S. PATENT DOCUMENTS 4,653,455 A * 3/1987 Eblen ..... F02M 57/02 123/506
2012/0090708 A1* 4/2012 Usui ..... F02M 37/043 137/565.16

(Continued)

FOREIGN PATENT DOCUMENTS

JP 10-122412 A 5/1998
JP 2003-207067 A 7/2003

(Continued)

OTHER PUBLICATIONS

International Search Report (PCT/ISA/210) issued in PCT Application No. PCT/JP2018/019582 dated Sep. 11, 2018 with English translation (five pages).

(Continued)

*Primary Examiner* — Joseph J Dallo
(74) *Attorney, Agent, or Firm* — Crowell & Moring LLP

(57) ABSTRACT

An object of the present invention is to provide a high-pressure fuel supply pump having a structure capable of adjusting the moving speed of an anchor. Therefore, the high-pressure fuel supply pump of the present invention is provided with a protrusion that protrudes toward an anchor side on a fixed core facing surface of a fixed core. The protrusion is configured in such a manner that a minimum distance between the protrusion and an anchor facing surface is smaller than an axial gap dimension configured between the fixed core facing surface and the anchor facing surface in a direction along a central axis in a state where the anchor is stationary at the time of non-energization.

4 Claims, 13 Drawing Sheets

(56) References Cited

U.S. PATENT DOCUMENTS

| | | | | |
|---|---|---|---|---|
| 2015/0198126 | A1 | 7/2015 | Marechal et al. | |
| 2016/0281693 | A1* | 9/2016 | Aritomi | F02M 63/0077 |
| 2016/0305384 | A1 | 10/2016 | Avireddi et al. | |
| 2017/0342935 | A1* | 11/2017 | Arihara | F02D 41/20 |
| 2018/0010562 | A1* | 1/2018 | Oikawa | F02M 59/366 |
| 2018/0087502 | A1* | 3/2018 | Ohgane | F02M 59/027 |
| 2018/0135579 | A1* | 5/2018 | Kusakabe | F02M 51/00 |

FOREIGN PATENT DOCUMENTS

| | | | |
|---|---|---|---|
| JP | 2015-218675 | A | 12/2015 |
| JP | 2016-205375 | A | 12/2016 |
| JP | 2016-219617 | A | 12/2016 |
| JP | 2017-14920 | A | 1/2017 |
| WO | WO 2016/208359 | A1 | 12/2016 |

OTHER PUBLICATIONS

Japanese-language Written Opinion (PCT/ISA/237) issued in PCT Application No. PCT/JP2018/019582 dated Sep. 11, 2018 (three pages).

Japanese-language Office Action issued in Japanese Application No. 2019-526685 dated May 12, 2020 with English translation (seven (7) pages).

Extended European Search Report issued in European Application No. 18824511.2 dated Jan. 28, 2021 (seven (7) pages).

* cited by examiner

HIGH-PRESSURE FUEL SUPPLY PUMP

TECHNICAL FIELD

The present invention relates to a high-pressure fuel supply pump that pumps fuel to a fuel injection valve of an internal combustion engine, and more particularly to a high-pressure fuel supply pump that includes an electromagnetic intake valve that adjusts the amount of fuel to be discharged.

BACKGROUND ART

In a direct injection type internal combustion engine that injects fuel into a combustion chamber among internal combustion engines for an automobile and the like, a high-pressure fuel supply pump including an electromagnetic intake valve is widely used to increase the pressure of the fuel and discharge fuel at a desired fuel flow rate.

As such a high-pressure fuel supply pump, a high-pressure fuel supply pump described in JP 2015-218675 A (PTL 1) is known. In the high-pressure fuel supply pump of PTL 1, an inclined portion is provided on a collision surface between an anchor and a fixed core, and the anchor and the fixed core are configured to collide with each other at the inclined portion (see paragraphs 0064 and 0065, and FIG. 5(B)). Further, PTL 1 describes the high-pressure fuel supply pump, in which a surface perpendicular to a movable direction of the anchor is provided on the inner peripheral side of the inclined portions of the anchor and the fixed core, the anchor and the fixed core abut on each other on these perpendicular surfaces, and a gap is formed between the anchor and the fixed core at the inclined portion when the anchor and the fixed core abut on each other (see paragraph 0068 and FIG. 6). Note that, in the high-pressure fuel supply pump of PTL 1, a closed magnetic circuit that crosses a magnetic gap between the anchor and the fixed core is configured on the inclined portion, and a magnetic attractive force is applied between the anchor and the fixed core in this closed magnetic circuit, so that the anchor is attracted to the fixed core (see paragraphs 0032 and 0057 and FIG. 3(A)).

Further, JP 2017-014920 A (PTL 2) describes a high-pressure fuel supply pump that includes a solenoid valve provided with a mover driven by a magnetic force and a stopper with which the mover collides. A flat portion serving as a magnetic attraction surface is formed on a facing surface of the mover facing the stopper, and a curved surface portion is formed on the outer peripheral side. A flat portion serving as a magnetic attraction surface is formed on a facing surface of the stopper facing the mover, and a curved surface portion is formed on the outer peripheral side. The curved surface portion on the stopper side is formed at a position corresponding to the curved surface portion on the mover side, and is inclined in the same direction as that of the curved surface portion on the mover side (see paragraph 0040).

CITATION LIST

Patent Literature

PTL 1: JP 2015-218675 A
PTL 2: JP 2017-014920 A

SUMMARY OF INVENTION

Technical Problem

In the high-pressure fuel supply pump of PTL 1, the inclined portion is provided on the collision surface between the anchor and the fixed core. Further, in the high-pressure fuel supply pump of PTL 2, the flat portions serving as magnetic attraction surfaces are formed on the facing surfaces of the mover and the stopper, and the curved surface portions are formed on the outer peripheral sides. However, in the high-pressure fuel supply pumps of PTL 1 and PTL 2, consideration is not given to using the inclined portion or the curved surface portion formed on the collision surface or the facing surface as a means for adjusting a moving speed of the anchor or the mover.

In a case where the facing surfaces of the anchor and the fixed core, or the facing surfaces of the mover and the stopper are configured of a simple flat surface, the speed of the anchor or the mover (hereinafter referred to as the anchor) becomes nonlinearly larger as a distance to the fixed core or the stopper (hereinafter referred to as the fixed core) becomes shorter. For this reason, the speed at which the anchor or the mover collides with the fixed core or the stopper becomes large, and cavitation erosion is likely to occur due to the jet generated by the collision between the anchor and the fixed core, and a collision force that the anchor exerts on the fixed core is large. For this reason, there is a problem that a generated collision sound and damage to the collision portion are large.

An object of the present invention is to provide a high-pressure fuel supply pump having a structure capable of adjusting the moving speed of an anchor.

Solution to Problem

In order to achieve the above object, according to the present invention, there is provided a high-pressure fuel supply pump including an electromagnetic intake valve having a fixed core, an anchor that faces the fixed core in a direction along a central axis and is biased to a side away from the fixed core, and an electromagnetic coil. The high-pressure fuel supply pump causes a magnetic attractive force to act between a fixed core facing surface of the fixed core facing the anchor and an anchor facing surface of the anchor facing the fixed core to drive the anchor toward the fixed core and change a discharge amount of fuel as the electromagnetic coil is energized. In the high-pressure fuel supply pump, the fixed core has a protrusion protruding to the anchor side on the fixed core facing surface, in a state where the anchor is stationary when the electromagnetic coil is not energized, a minimum distance between the protrusion of the fixed core and the anchor facing surface is configured to be smaller than an axial gap dimension configured between the fixed core facing surface and the anchor facing surface in a direction along the central axis, and the protrusion is located on a radially outer side with respect to an outer peripheral surface of the anchor or a radially inner side with respect to an inner peripheral surface of the anchor without contacting the anchor in a state where the anchor abuts on the fixed core when the electromagnetic coil is energized.

Advantageous Effects of Invention

According to the present invention, a high-pressure fuel supply pump having a structure capable of adjusting the moving speed of an anchor can be provided. An object, a configuration, and an advantageous effect other than those described above will be clarified in description of embodiments described below.

DESCRIPTION OF EMBODIMENTS

Hereinafter, embodiments of the present invention will be described in detail with reference to the drawings. Note that, similar configurations are attached with the same reference signs in each embodiment, and omitted from description in an embodiment that follows.

First Embodiment

Figure 1:
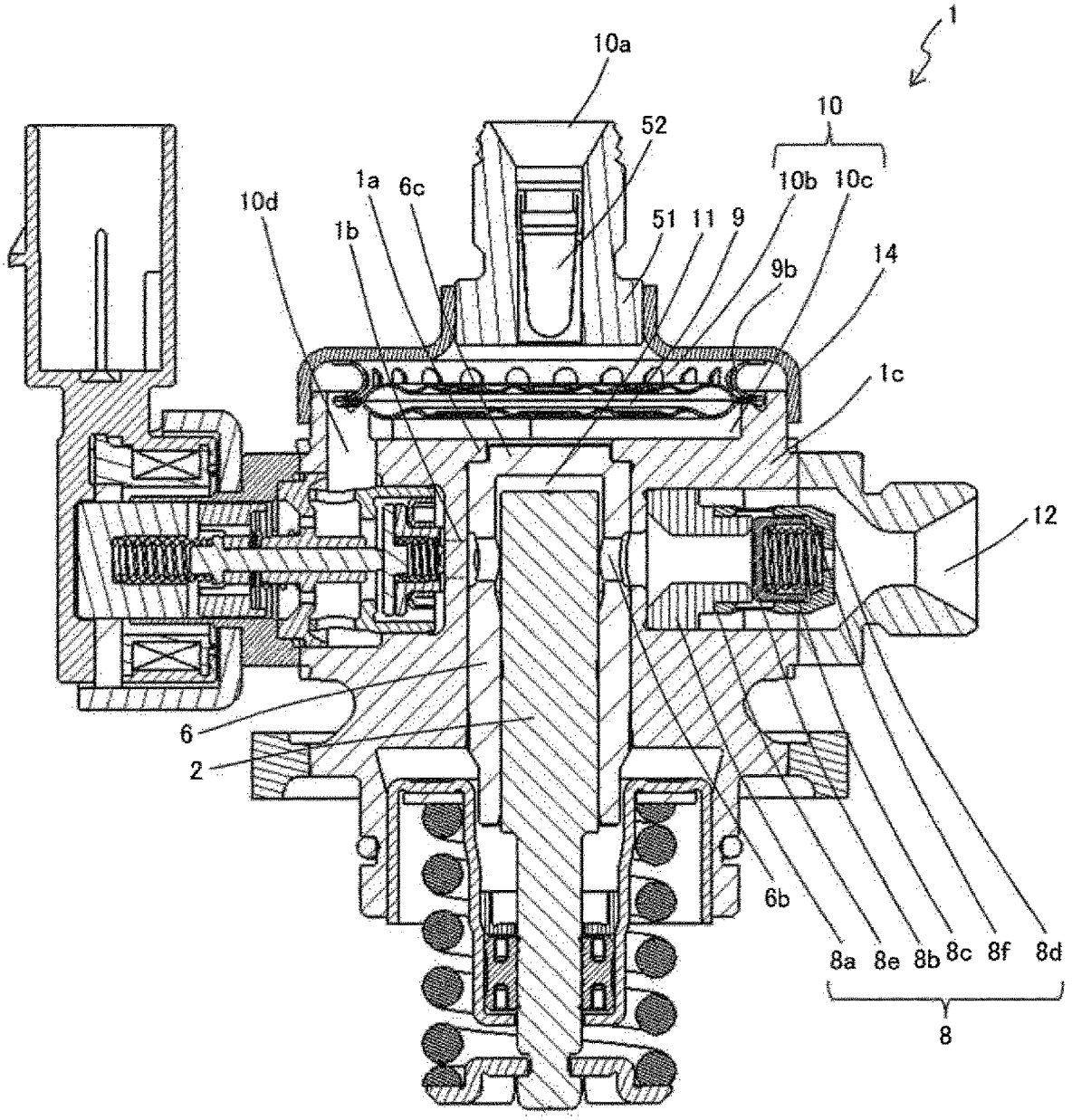
FIG. 1 is a cross-sectional view showing a cross section of a high-pressure fuel supply pump according to an embodiment (first embodiment) of the present invention that is parallel to a central axis direction of a plunge and includes the central axis of the plunge.
Figure 2:
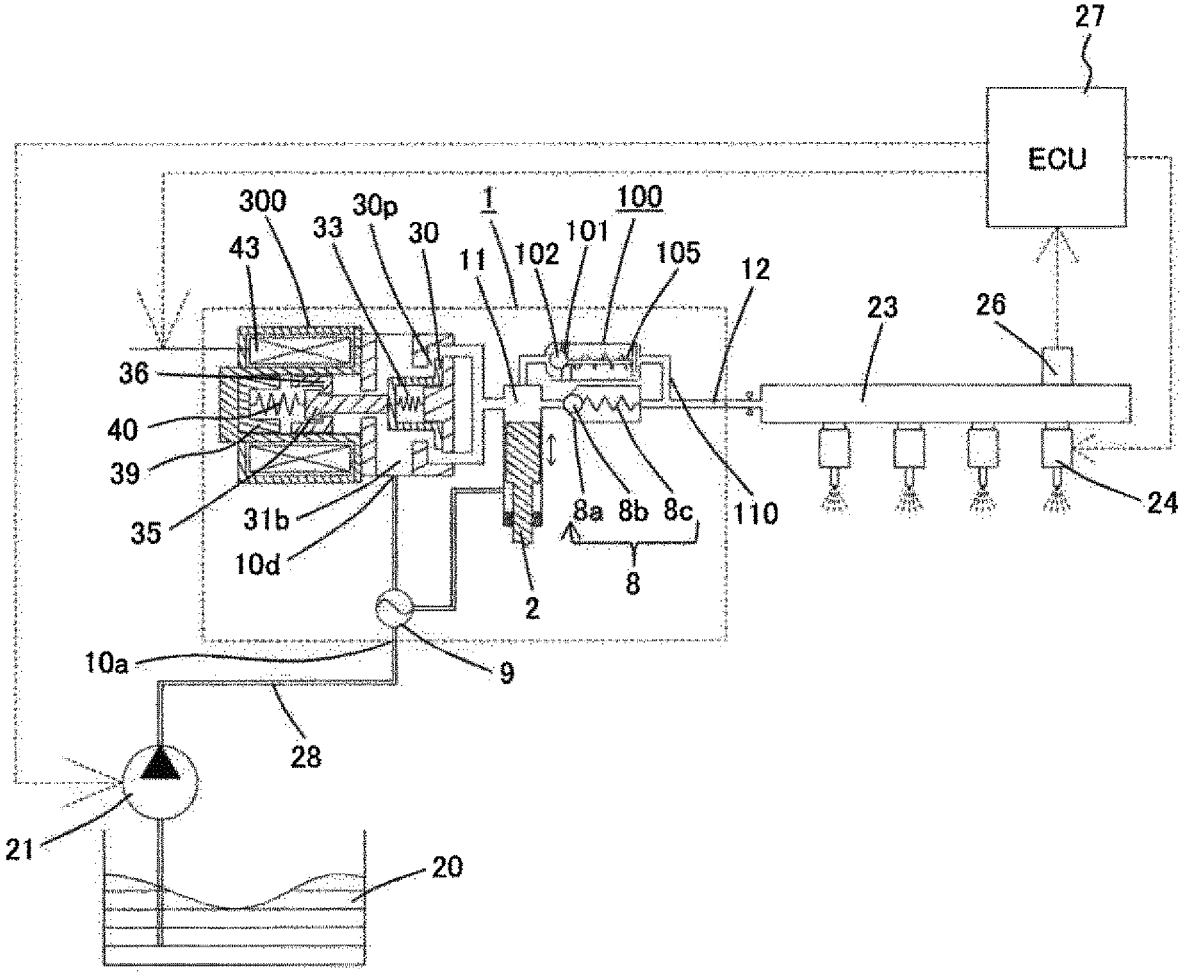
FIG. 2 is a diagram showing an example of a fuel supply system including the high-pressure fuel supply pump according to the first embodiment of the present invention.

The configuration and operation of a system will be described with reference to FIGS. 1 and 2. FIG. 1 is a cross-sectional view showing a cross section of a high-pressure fuel supply pump according to an embodiment (first embodiment) of the present invention that is parallel to a central axis direction of a plunge and includes the central axis of the plunge. FIG. 2 is a diagram showing an example of a fuel supply system including the high-pressure fuel supply pump according to the first embodiment of the present invention. In FIG. 2, a portion surrounded by a broken line indicates a main body of a high-pressure fuel supply pump 1, and a mechanism and a component shown in the broken line are shown to be integrated into a main body 1*c* of the high-pressure fuel supply pump 1. Hereinafter, the high-pressure fuel supply pump 1 will be described as a high-pressure pump.

Fuel in a fuel tank 20 is pumped up by a feed pump 21 based on a signal from an engine control unit 27 (hereinafter referred to as ECU), pressurized to an appropriate feed pressure, and sent to a low-pressure fuel intake port 10*a* of the high-pressure pump 1 through an intake pipe 28.

The fuel that has passed through an intake joint 10*a* reaches an intake port 31*b* of the electromagnetic intake valve (electromagnetic intake valve mechanism) 300 that constitutes a variable capacity mechanism via a pressure pulsation reduction mechanism 9 and an intake path 10*d*.

The fuel that has flowed into the electromagnetic intake valve 300 passes through an intake valve 30 and flows into a pressurizing chamber 11. Power for reciprocating movement is applied to a plunger 2 by a cam mechanism of an engine, and fuel is sucked from the intake valve 30 during a downward stroke of the plunger 2 by reciprocating movement of the plunger 2. Further, the fuel is pressurized during an upward stroke of the plunger 2. When the fuel pressure in the pressurizing chamber 11 becomes higher than fuel pressure in a discharge path 12 during this upward stroke, a discharge valve 8 is opened. Then, the fuel is pumped through the discharge valve 8 to a common rail 23 on which a pressure sensor 26 is mounted. High-pressure fuel in the common rail 23 is injected into the engine by an injector 24 based on a signal from the ECU 27.

In the high-pressure pump 1, the electromagnetic intake valve 300 is driven and controlled based on a signal sent from the ECU 27, and the fuel is discharged to the common rail 23 so that a desired supply fuel flow rate is obtained.

A relief valve 100 is configured to prevent an abnormal high pressure. When the fuel pressure in the common rail 23 or the discharge path 12 rises to an abnormal high pressure that is equal to or higher than a set pressure of the relief valve 100, the relief valve 100 is opened. In this manner, the fuel in the common rail 23 or the discharge path 12 is returned to the pressurizing chamber 11 of the high-pressure pump 1, so that an abnormal high-pressure state in the common rail 23 is prevented.

The pump main body 1*c* is further provided with a relief path 110 that communicates the discharge path 12 on the downstream side of a discharge valve 8*b* with the pressurizing chamber 11, bypassing the discharge valve 8. The relief path 110 is provided with a relief valve 102 that restricts the flow of fuel to only one direction from the discharge path 12 to the pressurizing chamber 11. The relief valve 102 is pressed against a relief valve seat 101 by a relief spring 105 that generates a pressing force. When a pressure difference between the pressurizing chamber 11 and the relief path 110 becomes a set pressure that is set in advance or more, the relief valve 102 is set to be separated from the relief valve seat 101 and opened.

In a case where the common rail 23 has an abnormally high pressure due to a failure and the like of the electromagnetic intake valve 300 of the high-pressure pump 1, when a differential pressure between the relief path 110 communicating with the discharge path 12 and the pressurizing chamber 11 is equal to or higher than the opening pressure of the relief valve 102, the relief valve 102 is opened. In this manner, fuel having an abnormally high pressure in the discharge path 12 is returned from the relief path 110 to the pressurizing chamber 11, and a pipe on the high-pressure side, such as the common rail 23, is protected.

Figure 3:
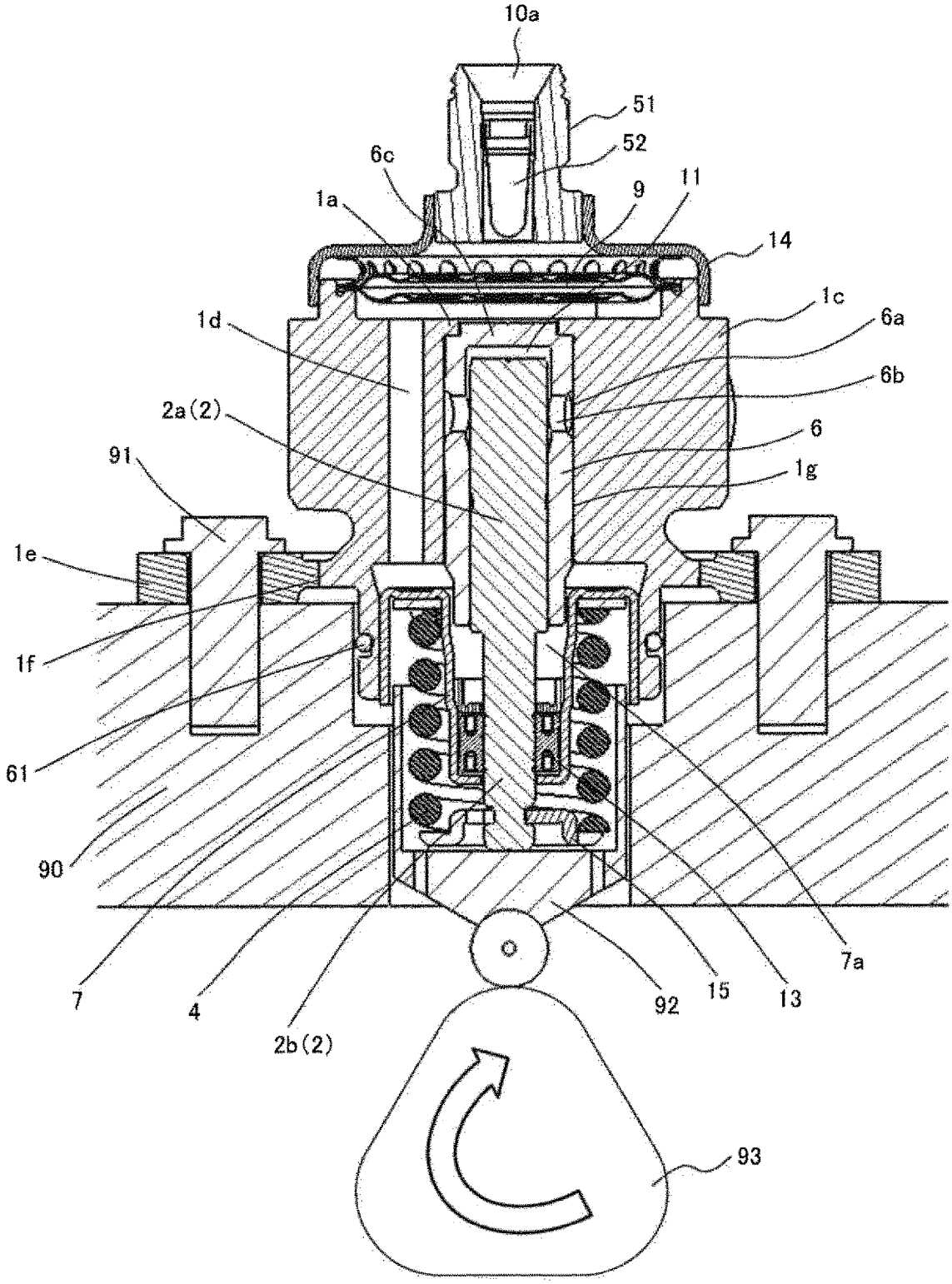
FIG. 3 is a cross-sectional view of the high-pressure fuel supply pump according to the first embodiment of the present invention as viewed from a direction different from that in FIG. 1, and is a cross-sectional view also showing an attached state to an engine.

The configuration and operation of the high-pressure pump 1 will be described with reference to FIGS. 1, 2, and 3. FIG. 3 is a cross-sectional view of the high-pressure fuel supply pump according to the first embodiment of the present invention as viewed from a direction different from that in FIG. 1, and is a cross-sectional view also showing an attached state to an engine.

In general, in the high-pressure pump 1, a flange 1*e* provided in the pump main body 1*c* is in close contact with a flat surface of a cylinder head 90 of an internal combustion engine, and fixed with a plurality of bolts 91. The mounting flange 1*e* has a whole circumference welded and joined to the pump main body 1*c* at a welded portion if to form an annular fixed portion. In the present embodiment, laser welding is used.

An O-ring 61 is fitted into the pump main body 1*c* for sealing between the cylinder head 90 and the pump main body 1*c* to prevent engine oil from leaking to the outside.

A cylinder 6 is attached to the pump main body 1*c*. The cylinder 6 has an end portion formed in a bottomed tubular shape so as to guide reciprocating movement of the plunger 2 and form the pressurizing chamber 11 in the inside. Further, the cylinder 6 is provided with an annular groove 6*a* formed in an annular shape on an outer peripheral side and a plurality of communication holes 6*b* for communicating the annular groove 6*a* and the pressurizing chamber 11. The annular groove 6*a* and the communication holes 6*b* are provided so that the pressurizing chamber 11 communicates with the electromagnetic intake valve 300 for supplying fuel and the discharge valve mechanism 8 for discharging fuel from the pressurizing chamber 11 to the discharge path 12.

The cylinder 6 has its outer peripheral surface press-fitted and fixed to a cylinder fitting hole 1*g* of the pump main body 1*c*, and seals with a press-fitted portion cylindrical surface (outer peripheral surface) so as to prevent pressurized fuel from leaking to a low pressure side from a gap with the pump main body 1*c*. Further, the cylinder 6 has a small-diameter portion 6*c* on an outer diameter on the pressurizing chamber 11 side, and the small-diameter portion 6*c* is fitted into a small-diameter portion 1*a* formed at an upper end portion (end portion on a low-pressure fuel chamber 10 side) of the cylinder fitting hole 1*g* of the pump main body 1*c*. As the fuel in the pressurizing chamber 11 is pressurized, a force directed toward the low-pressure fuel chamber 10 acts on the cylinder 6. However, by providing the small-diameter portion 1*a* in the pump main body 1*c*, the cylinder 6 is prevented from intruding into the low-pressure fuel chamber 10 side. The cylinder 6 brings the upper end formed with the small-diameter portion 6*c* into contact with a flat surface formed on the small-diameter portion 1*a* of the pump main body 1*c* in an axial direction, so that a double seal structure is configured in addition to the seal by the press-fitted portion cylindrical surface (outer peripheral surface) between the pump main body 1*c* and the cylinder 6.

A tappet 92 that converts a rotation movement of a cam attached to a cam shaft of an internal combustion engine to a vertical movement and transmits the movement to the plunger 2 is provided at a lower end of the plunger 2. The plunger 2 is pressed and joined with the tappet 92 by a spring 4 with a retainer 15 provided between them. In this manner, the plunger 2 can perform reciprocating movement vertically with rotational movement of a cam 93.

Further, a plunger seal 13 held in an inner peripheral lower end portion of a seal holder 7 is installed in a lower end portion in the diagram of the cylinder 6 in a state of being slidably in contact with the outer periphery of the plunger 2. In this manner, the fuel in a low-pressure chamber 7*a* can be sealed even in a case where the plunger 2 slides, and the fuel is prevented from leaking to the outside. At the same time, the plunger seal 13 prevents a lubricant (including engine oil) that lubricates a sliding portion in the internal combustion engine from flowing into the pump main body 1*c*.

A damper cover 14 is fixed to a head of the pump main body 1*c*. The damper cover 14 is provided with an intake joint 51, and the intake joint 51 forms the low-pressure fuel intake port 10*a*. The fuel that has passed through the low-pressure fuel intake port 10*a* passes through a filter 52 fixed to the inner side of the intake joint 51, and reaches the intake port 31*b* of the electromagnetic intake valve 300 via the pressure pulsation reduction mechanism 9 and the low-pressure fuel channel 10*d*.

The intake filter 52 in the intake joint 51 prevents a foreign matter existing between the fuel tank 20 and the low-pressure fuel intake port 10*a* from flowing into the high-pressure pump 1 due to flow of fuel.

The plunger 2 has a large diameter portion 2*a* and a small-diameter portion 2*b*. When the plunger 2 is reciprocated by the large diameter portion 2*a* and the small-diameter portion 2*b*, the volume of an annular low-pressure fuel chamber 7*a* is increased or decreased. The annular low-pressure fuel chamber 7*a* communicates with the low-pressure fuel chamber 10 through the fuel path 1*d*, so that flow of fuel is generated from the annular low-pressure fuel chamber 7*a* to the low-pressure fuel chamber 10 when the plunger 2 moves down, and from the low-pressure fuel chamber 10 to the annular low-pressure fuel chamber 7*a* when the plunger 2 moves up.

In this manner, the fuel flow rate into and out of the pump in the intake stroke or return stroke of the high-pressure pump 1 can be reduced, and the function of reducing pulsation is provided.

The pressure pulsation reduction mechanism 9 that reduces spread of pressure pulsation generated in the high-pressure pump 1 to the fuel pipe 28 is installed in the low-pressure fuel chamber 10. Further, a damper upper portion 10*b* and a damper lower portion 10*c* are provided above and below the pressure pulsation reduction mechanism 9, respectively, with space between them. In a case where fuel that once flows into the pressurizing chamber 11 is returned to the intake path 10*d* (intake port 31*b*) through the intake valve body 30 in an open state for capacity control, the fuel that is returned to the intake path 10*d* (intake port 31*b*) generates pressure pulsation in the low-pressure fuel chamber 10. However, the pressure pulsation reduction mechanism 9 provided in the low-pressure fuel chamber 10 is formed of a metal damper in which two corrugated disk-shaped metal plates are bonded together at the outer periphery and inert gas such as argon is injected in the inside. The pressure pulsation is absorbed and reduced as the metal damper expands and contracts. An attaching metal fitting 9*b* is used for fixing the metal damper to an inner peripheral portion of the pump main body 1. The attaching metal fitting 9*b* is provided with a plurality of holes in order to be installed on the fuel path, so that a fluid can freely move back and forth on the front and back of the attaching metal fitting 9*b*.

The discharge valve mechanism 8 is provided at an exit of the pressurizing chamber 11. The discharge valve mechanism 8 is configured with a discharge valve seat 8*a*, a discharge valve 8*b* that contacts and separates from the discharge valve seat 8*a*, a discharge valve spring 8*c* that biases the discharge valve 8*b* toward the discharge valve seat 8*a*, and a discharge valve holder 8*d* that contains the discharge valve 8*b* and the discharge valve seat 8*a*. The discharge valve seat 8*a* and the discharge valve holder 8*d* are joined by welding at an abutting portion 8*e* to form the integral discharge valve mechanism 8.

Note that a stepped portion 8*f* that forms a stopper that restricts the stroke of the discharge valve 8*b* is provided inside the discharge valve holder 8*d*.

In a state where there is no fuel pressure difference between the pressurizing chamber 11 and the fuel discharge port 12, the discharge valve 8*b* is pressed against the discharge valve seat 8*a* by a biasing force of the discharge valve spring 8*c*, and is in a closed state. Only after the fuel pressure in the pressurizing chamber 11 becomes higher than the fuel pressure at the fuel discharge port 12, the discharge valve 8*b* is opened against the biasing force of the discharge valve spring 8*c*, and the fuel in the pressurizing chamber 11 is discharged to the common rail 23 at high pressure through the fuel discharge port 12. When opened, the discharge valve 8*b* comes into contact with the discharge valve stopper 8*f*, and the stroke is limited. Therefore, the stroke of the discharge valve 8*b* is appropriately determined by the discharge valve stopper 8*d*. This prevents fuel that is discharged at high pressure to the fuel discharge port 12 from flowing back again into the pressurizing chamber 11 due to a too-large stroke causing a delay in closing the discharge valve 8*b*, and lowering in efficiency of the high-pressure pump 1 can be suppressed. Further, when the discharge valve 8*b* repeats opening and closing movements, the discharge valve 8*b* is guided on an inner peripheral surface of the discharge valve holder 8*d* so as to move only in the stroke direction. By the above configuration, the discharge valve mechanism 8 becomes a check valve that restricts a circulation direction of fuel to one direction.

With these configurations, the pressurizing chamber 11 is configured with the pump housing 1, the electromagnetic intake valve 300, the plunger 2, the cylinder 6, and the discharge valve mechanism 8.

When the plunger 2 moves in the cam 93 direction by rotation of the cam 93 and is in a state of an intake stroke, the capacity of the pressurizing chamber 11 is increased and the fuel pressure in the pressurizing chamber 11 is lowered. In this stroke, when the fuel pressure in the pressurizing chamber 11 becomes lower than the pressure in the intake path 10*d*, the fuel passes through the intake valve 30 in the open state, a communication hole 1*b* provided in the pump main body 1*c*, and a cylinder outer peripheral path 6*a*, and flows into the pressurizing chamber 11.

The plunger 2 makes a transition to a compression stroke after completing the intake stroke. Here, an electromagnetic coil 43 maintains a non-energized state, and no magnetic biasing force from a fixed core 39 acts on an anchor 36. Therefore, the intake valve 30 remains to be opened by the biasing force of a rod biasing spring 40. The volume of the pressurizing chamber 11 decreases with the compression movement of the plunger 2. However, in this state, the fuel once sucked into the pressurizing chamber 11 is returned to the intake path 10*d* again through the intake valve 30 in the open state. Therefore, the pressure in the pressurizing chamber 11 does not increase. This stroke will be referred to as a return stroke.

In this state, when a control signal from the ECU 27 is applied to the electromagnetic intake valve 300, a current flows in the electromagnetic coil 43, the anchor 36 and a rod 35 move in a direction of separating from the intake valve 30 by a magnetic biasing force, and the intake valve 30 is closed by a biasing force of an intake valve biasing spring 33 and a fluid force of the fuel flowing into the intake path 10*d*. After the valve is closed, the fuel pressure of the pressurizing chamber 11 increases together with the upward movement of the plunger 2. When the fuel pressure in the pressurizing chamber 11 becomes equal to or higher than the pressure at the fuel discharge port 12, fuel is discharged at high pressure via the discharge valve mechanism 8, and high-pressure fuel is supplied to the common rail 23. This stroke will be referred to as a discharge stroke.

That is, the compression process (the upward stroke from the bottom dead center to the top dead center) of the plunger 2 consists of the return stroke and the discharge stroke. Then, by controlling an energizing timing of the electromagnetic coil 43, an amount of discharged high-pressure fuel can be controlled. When the timing of energizing the electromagnetic coil 43 is made earlier in the compression stroke, the proportion of the return stroke becomes smaller, and the proportion of the discharge stroke becomes larger. That is, an amount of fuel returned to the intake path 10*d* becomes smaller, and an amount of fuel that is discharged at high pressure becomes larger. On the other hand, when the timing of energization is delayed, the proportion of the return stroke becomes larger, and the proportion of the discharge stroke becomes smaller. That is, an amount of fuel returned to the intake path 10*d* becomes larger, and an amount of fuel that is discharged at high pressure becomes smaller. The energizing timing of the electromagnetic coil 43 is controlled by a command from the ECU 27.

By controlling the energizing timing of the electromagnetic coil 43 in the above configuration, an amount of fuel discharged at high pressure can be controlled to an amount required by an internal combustion engine.

Here, the electromagnetic intake valve 300 will be described in detail with reference to FIGS. 4 to 6.

Figure 4:
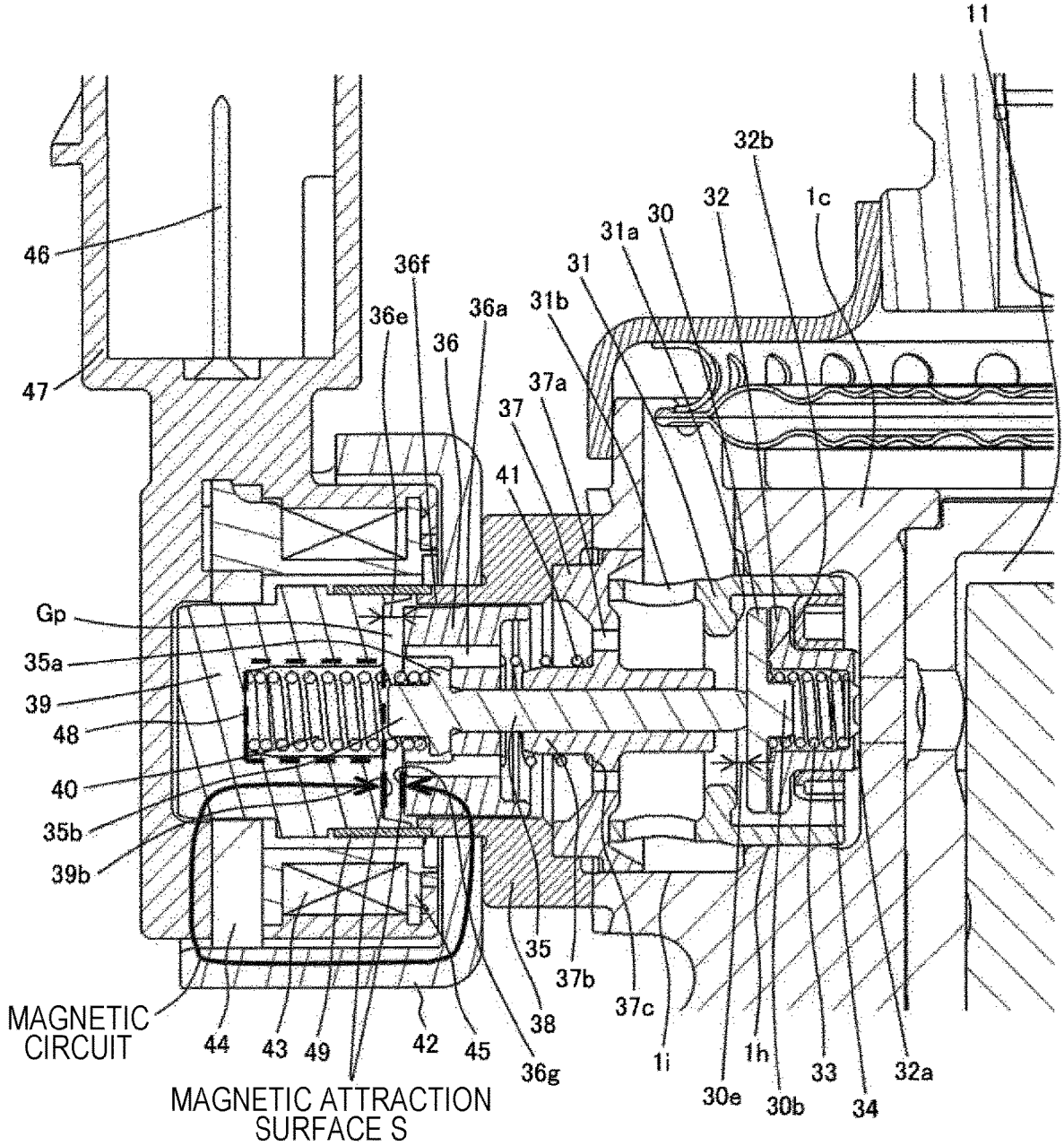
FIG. 4 is a cross-sectional view showing the vicinity of an electromagnetic intake valve in FIG. 1 in an enlarged manner, and shows a state where the electromagnetic intake valve is in an open state.

FIG. 4 is a cross-sectional view showing the vicinity of the electromagnetic intake valve in FIG. 1 in an enlarged manner, and shows a state where the electromagnetic intake valve is in an open state. The state in FIG. 4 is a non-energized state in which the electromagnetic coil 43 is not energized, and the pressure in the pressurizing chamber 11 is in a low-pressure state pumped by the feed pump 21. In this state, the intake stroke and the return stroke are performed.

Further, between a facing surface (referred to as an anchor facing surface, an anchor collision surface, or an anchor abutting surface) 36*g* of the anchor 36 that faces the fixed core 39 and a facing surface (referred to as a fixed core facing surface, a fixed core collision surface, or a fixed core abutting surface) 39*b* of the fixed core 39 facing the anchor 36, there exists a gap Gp that is set to a predetermined size. Note that the facing surface, the collision surface, or the abutting surface of the anchor 36 and the fixed core 39 may also be referred to as a facing portion, a collision portion, or an abutting portion.

Figure 5:
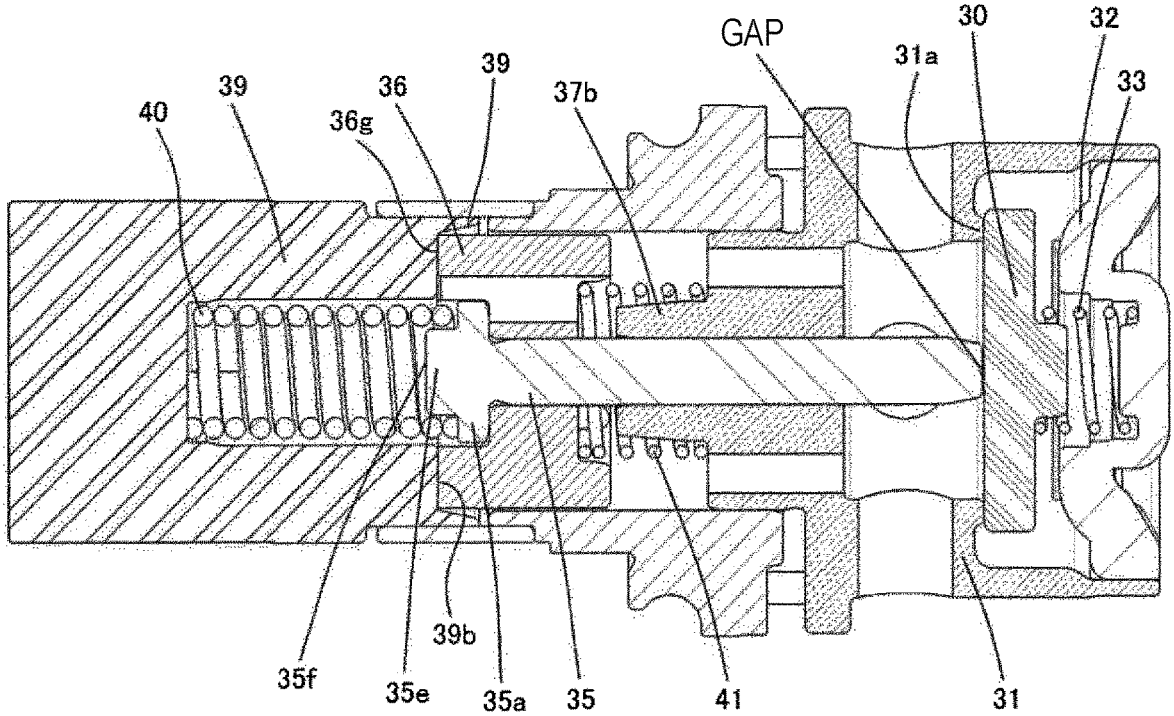
FIG. 5 is a cross-sectional view showing the electromagnetic intake valve of the high-pressure fuel supply pump according to the first embodiment of the present invention in an enlarged manner, and shows that the electromagnetic intake valve is in a closed state in an initial stage and the electromagnetic intake valve is energized.

FIG. 5 is a cross-sectional view showing the electromagnetic intake valve of the high-pressure fuel supply pump according to the first embodiment of the present invention in an enlarged manner, and shows that the electromagnetic intake valve is in a closed state in an initial stage and the electromagnetic intake valve is energized. The state of FIG. 4 is a state where the intake valve 30 is closed by the anchor 36, which is a movable part, coming into contact with the fixed core 39 by an electromagnetic attractive force when the electromagnetic coil 43 is energized.

Figure 6:
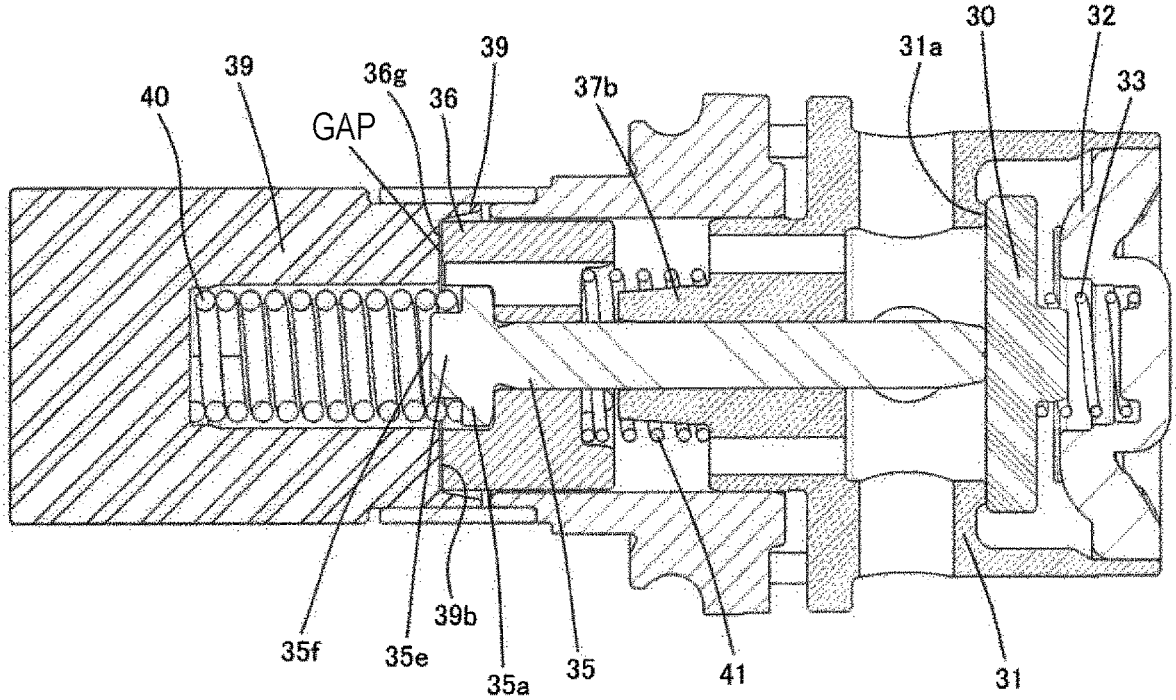
FIG. 6 is a cross-sectional view showing the electromagnetic intake valve of the high-pressure fuel supply pump according to the first embodiment of the present invention in an enlarged manner, and shows that the electromagnetic intake valve is in a closed state in a later stage and the electromagnetic intake valve is de-energized.

FIG. 6 is a cross-sectional view showing the electromagnetic intake valve of the high-pressure fuel supply pump according to the first embodiment of the present invention in an enlarged manner, and shows that the electromagnetic intake valve is in a closed state in a later stage and the electromagnetic intake valve is de-energized. The state of FIG. 5 is a state where the intake valve 30 is closed after the pressure in the pressurizing chamber (pump chamber) 11 is sufficiently increased, and the electromagnetic coil 43 is in a non-energized state after de-energization.

The intake valve portion consists of the intake valve 30, an intake valve seat 31, an intake valve stopper 32, an intake valve biasing spring 33, and an intake valve holder 34.

The intake valve seat member 31 has a cylindrical shape, and includes a seat portion 31*a* provided in the axial direction on the inner peripheral side and two or more intake path portions 31*b* provided radially around the axis of the cylinder. The intake valve seat member 31 has an outer peripheral cylindrical surface press-fitted into an inner peripheral surface of a fitting recess 1*h* of the pump main body 1*c* and held in the pump main body 1*c*.

The intake valve holder 34 has claws in two or more directions radially, and the outer peripheral side of the claw is coaxially fitted to the inner peripheral side of the intake valve seat member 31 and is held by the intake valve seat member 31. Furthermore, an intake valve stopper 32 having a cylindrical shape and having a collar shape at one end is press-fitted and held on the inner peripheral cylindrical surface of the intake valve holder 34.

The intake valve biasing spring 33 is disposed on the inner peripheral side of the intake valve stopper 32. On the intake valve stopper 32, a small-diameter portion for stably holding one end of the intake valve biasing spring 33 coaxially, and the one end of the intake valve biasing spring 33 is disposed in this small-diameter portion. The intake valve 30 is disposed between the intake valve seat portion 31*a* and the intake valve stopper 32.

The intake valve 30 is formed so that a valve guide portion 30*b* protrudes on the surface opposite to the side facing the intake valve seat portion 31*a*. The intake valve biasing spring 33 is disposed in such a manner that one end abuts against the bottom of the intake valve stopper 32 and the other end is fitted to the valve guide portion 30*b*. The intake valve biasing spring 33 is a compression coil spring and is installed so that a biasing force acts in the direction in which the intake valve 30 is pressed against the intake valve seat portion 31*a*. The intake valve biasing spring 33 is not limited to a compression coil spring, and may have any form as long as a biasing force can be obtained, and one like a leaf spring having a biasing force integrated with the intake valve 30 may be used.

By configuring the intake valve portion in this manner, in the intake stroke of the high-pressure pump 1, the fuel that enters the inside through the intake path 31*b* passes through a fuel path 30*p* opened between the intake valve 30 and the seat portion 31*a*, passes between the outer peripheral side of the intake valve 30 and the claw of the intake valve holder 34, passes through the pump main body 1*c* and the paths 6*a* and 6*b* of the cylinder 6, and flows into the pressurizing chamber (pump chamber) 11. Further, in the discharge stroke of the high-pressure pump 1, the intake valve 30 performs contact sealing with the intake valve seat portion 31*a* so as to function as a check valve that prevents backflow of fuel to the inlet side.

In order to make the movement of the intake valve 30 smooth, a path 32*a* is provided in order to release the hydraulic pressure on the inner peripheral side of the intake valve stopper 32 according to the movement of the intake valve 30.

A movement amount 30*e* in the axial direction of the intake valve 30 is limited and regulated by the intake valve stopper 32. This is because if the movement amount is too large, the reverse flow rate of the fuel increases due to a response delay when the intake valve 30 is closed, and the performance as a pump is lowered. The movement amount can be regulated by the shape and size in the axial direction of the intake valve seat 31*a*, the intake valve 30, and the intake valve stopper 32 and the press-fitting position.

The intake valve stopper 32 is provided with an annular protrusion 32*b* to reduce the contact area with the intake valve stopper 32 in a state where the intake valve 32 is opened. This is for allowing the intake valve 32 to be easily separated from the intake valve stopper 32 at the time of the transition from the opened state to the closed state, that is, for improving valve closing responsiveness. When the annular protrusion 32*b* does not exist, that is, when the contact area between the intake valve 32 and the intake valve stopper 32 is large, a large squeezing force is applied between the intake valve 30 and the intake valve stopper 32, and the intake valve 30 is less easily separated from the intake valve 32.

For the intake valve 30, the intake valve seat 31*a*, and the intake valve stopper 32 which repeatedly collide with each other during operation, a material obtained by applying heat treatment to martensitic stainless steel that has high strength, high hardness, and excellent corrosion resistance is used. For the intake valve biasing spring 33 and the intake valve holder 34, an austenitic stainless steel material is used in consideration of corrosion resistance.

Next, a solenoid mechanism portion will be described. The solenoid mechanism portion consists of the rod 35 that is a movable part, the anchor 36, a rod guide member 37 that is a fixed part, a first core 38, the fixed core 39, the rod biasing spring 40, and an anchor biasing spring 41.

The rod 35 as a movable part and the anchor 36 are configured as separate members. The rod 35 is slidably held in the axial direction on the inner peripheral side of the rod guide member 37, and the inner peripheral side of the anchor 36 is slidably held on the outer peripheral side of the rod 35. That is, both the rod 35 and the anchor 36 are configured to be slidable in the axial direction within a geometrically regulated range.

The rod 35 having a flange portion 35*a* can lock the anchor 36. For this reason, when the anchor 36 moves to the fixed core 39 side, the rod 35 can move together with the anchor 36. Therefore, the rod 35 can move in the valve closing direction when a magnetic attractive force acts on the anchor 36.

The anchor 36 has one or more through-holes 36*a* penetrating the component in the axial direction in order to smoothly and freely move in the axial direction (valve opening and closing direction of the intake valve 30) of the rod 35 in the fuel, so that restriction on movement due to a pressure difference between the front and rear of the anchor is eliminated as much as possible. The anchor 36 may be referred to as a movable core or a movable iron core.

Between the anchor 36 and the intake valve 30, a valve closing biasing spring 41 that biases the anchor 36 in the valve closing direction and the rod guide member 37 that guides the rod 35 in the valve opening and closing valve direction are disposed. The rod guide member 37 has a guide portion 37*b* for guiding the rod 35 in the valve opening a closing direction, and constitutes a spring seat 37*c* of the anchor biasing spring 41.

The rod guide member 37 is inserted on the inner peripheral side of a hole 1*i* into which the intake valve 30 of the pump main body 1*c* is inserted, and is caused to abut against one end of the intake valve seat member 31 in the axial direction. The rod guide member 37 is disposed so as to be sandwiched between the first core 38 welded and fixed to the pump main body 1*c* and the pump main body 1*c*. The rod guide member 37 is also provided with a through-hole 37*a* penetrating in the axial direction like the anchor 36, and is configured so that the pressure of the fuel chamber on the anchor 36 side does not interfere with the movement of the anchor 36 so that the anchor 36 can move freely and smoothly.

The anchor 36, the anchor biasing spring 41, the rod 35, and the like are disposed on the inner peripheral side of an electromagnetic intake valve housing 38 that is fixed to the pump main body 1*c*. Further, the fixed core 39, the rod biasing spring 40, the electromagnetic coil 43, and the like are held in the electromagnetic intake valve housing 38. Note that the rod guide member 37 is disposed on the opposite side of the fixed core 39 and the electromagnetic coil 43 with respect to the electromagnetic intake valve housing 38.

FIG. 4 shows the example in which the rod guide member 37 and the intake valve seat member 31 are configured as separate members. However, these members can also be configured as a single member as shown in FIGS. 5 and 6.

The electromagnetic intake valve housing 38 is fixed to the pump main body 1*c* by welding. The electromagnetic intake valve housing 38 has a thin cylindrical shape on the side opposite to the portion to be welded to the pump main body 1*c*, and the fixed core 39 is fixed to the tip of the thin cylindrical shape portion. An annular member 49 is provided across the outer peripheral surface of the thin cylindrical shape portion of the electromagnetic intake valve housing 38 and the outer peripheral surface of the fixed core 39, and welding or the like is performed between the thin cylindrical shape portion and the annular member 49, and between the fixed core 39 and the annular member 49, and the fixed core 39 is fixed to the electromagnetic intake valve housing 38 with the annular member 49 interposed between them.

The electromagnetic intake valve housing 38 and the fixed core 39 are preferably made from a magnetic material, and the annular member 49 is preferably made from a non-magnetic material. The annular member 49 may be constituted by part of the electromagnetic intake valve housing 38, and a portion corresponding to the annular member 49 of the electromagnetic intake valve housing 38 may be demagnetized.

The electromagnetic intake valve housing 38 can be regarded as part of an iron core of the electromagnetic coil 43. For this reason, in the present embodiment, the electromagnetic intake valve housing 38 is referred to as a first core, and the fixed core 39 is referred to as a second core. Further, the fixed core 39 may be referred to as a fixed iron core.

Spring space 48 is formed on the inner peripheral side of the second core 39, and the rod biasing spring 40 is disposed in the spring space 48. The rod biasing spring 40 is disposed such that one end of the rod biasing spring 40 abuts on the bottom surface of the second core 39 and the other end abuts on the rod collar portion 35*a* using a small-diameter portion 35*b* of the rod 35 as a guide. In this manner, the rod biasing spring 40 provides a biasing force in a direction in which the tip (the end on the intake valve 30 side) of the rod 35 contacts the intake valve 30 and pulls the intake valve 30 away from the intake valve seat portion 31*a*, that is, the opening direction of the intake valve 30.

The anchor biasing spring 41 is disposed to provide a biasing force to the anchor 36 in the direction of the rod collar portion 35*a* while keeping coaxial with the guide portion 37*b* by having one end inserted into the guide portion 37*b* of a cylindrical shape diameter on the center side of the rod guide member 37.

A movement amount 36*e* of the anchor 36 is set to be larger than the movement amount 30*e* of the intake valve 30.

This is to ensure that the intake valve 30 can be closed.

Since the rod 35 and the rod guide member 37 slide relative to each other, and the rod 35 repeatedly collides with the intake valve 30, a heat-treated martensitic stainless steel is used in consideration of hardness and corrosion resistance. For the anchor 36 and the second core 39, magnetic stainless steel is used to form a magnetic circuit, and, furthermore, the collision surface of the anchor 36 and the collision surface of the second core 39 are applied with surface treatment for improving hardness. For this surface treatment, hard Cr plating or the like can be used, without limitation to this. Austenitic stainless steel is used for the rod biasing spring 40 and the anchor biasing spring 41 in consideration of corrosion resistance.

Three springs are configured in the intake valve portion and the solenoid mechanism portion. These springs are the intake valve biasing spring 33 configured in the intake valve portion and the rod biasing spring 40 and the anchor biasing spring 41 configured in the solenoid mechanism portion. In the present embodiment, a coil spring is used for all the springs. However, any spring can be used as long as an biasing force can be obtained.

The spring force of the three springs 33, 40, and 41 is set so as to satisfy the following inequality:

$$FS40 > FS41 + FS33 + FF \quad (1)$$

where FS40: Force of the rod biasing spring 40

FS41: Force of the anchor biasing spring 41

FS33: Force of the intake valve biasing spring 33

FF: Force of a fluid closing the intake valve 30.

Due to this relationship, at the time of non-energization, a force f1 acts in the direction in which the rod 35 pulls the intake valve 30 away from the intake valve seat portion 31*a*, that is, in the direction in which the valve opens, due to each spring force.

From Inequality (1), f1 is obtained as follows:

$$f1=FS40-(FS41+FS33+FF) \quad (2).$$

Next, a configuration of a coil portion will be described.

The coil portion consists of a first yoke 42, the electromagnetic coil 43, a second yoke 44, a bobbin 45, a terminal 46, and a connector 47. The electromagnetic coil 43 in which a copper wire is wound around a bobbin 45 in a plurality of turns is disposed so as to be surrounded by the first yoke 42 and the second yoke 44, and is molded and fixed integrally with the connector 47 which is a resin member. One end of each of the two terminals 46 is connected to corresponding one of both ends of copper wires of the electromagnetic coil 43 so as to be energized. The terminal 46 is molded integrally with the connector 47, and the other end exposed from the mold resin is configured to be connectable to the ECU 27 side.

The coil portion is fixed as a hole at the center of the first yoke 42 is press-fitted into the first core 38. At that time, the inner diameter side of the second yoke 44 is configured to come into contact with or close with a slight clearance to the second core 39.

Both the first yoke 42 and the second yoke 44 are made from a magnetic stainless steel material in order to constitute a magnetic circuit and in consideration of corrosion resistance, and, for the bobbin 45 and the connector 47, resin having high strength and heat resistance is used in consideration of strength characteristics and heat resistance characteristics. Copper is used for the coil 43, and brass plated with metal is used for the terminal 46.

By configuring the solenoid mechanism portion and the coil portion as described above, the first core 38, the first yoke 42, the second yoke 44, the second core 39, and the anchor 36 form a magnetic circuit as shown by an arrow section in FIG. 4. When current is applied to the electromagnetic coil 43, an electromagnetic force is generated between the second core (fixed core) 39 and the anchor (movable core) 36, and a force attracting each other is generated. The first core 38 and the second core 39 are separated in the vicinity of the axial portion where the second core 39 and the anchor 36 face each other and a magnetic attractive force is generated, and g1 (see FIG. 10) is formed, so that almost all magnetic fluxes pass between the second core 39 and the anchor 36. For this reason, the electromagnetic intake valve 300 of the present embodiment can efficiently obtain an electromagnetic force.

When the electromagnetic force exceeds f1 described above, the anchor 36, which is a movable part, can perform movement of being attracted to and coming into contact with the second core 39 together with the rod 35, and the second core 39 and the anchor 36 can continue to be in contact with each other.

Figure 7:
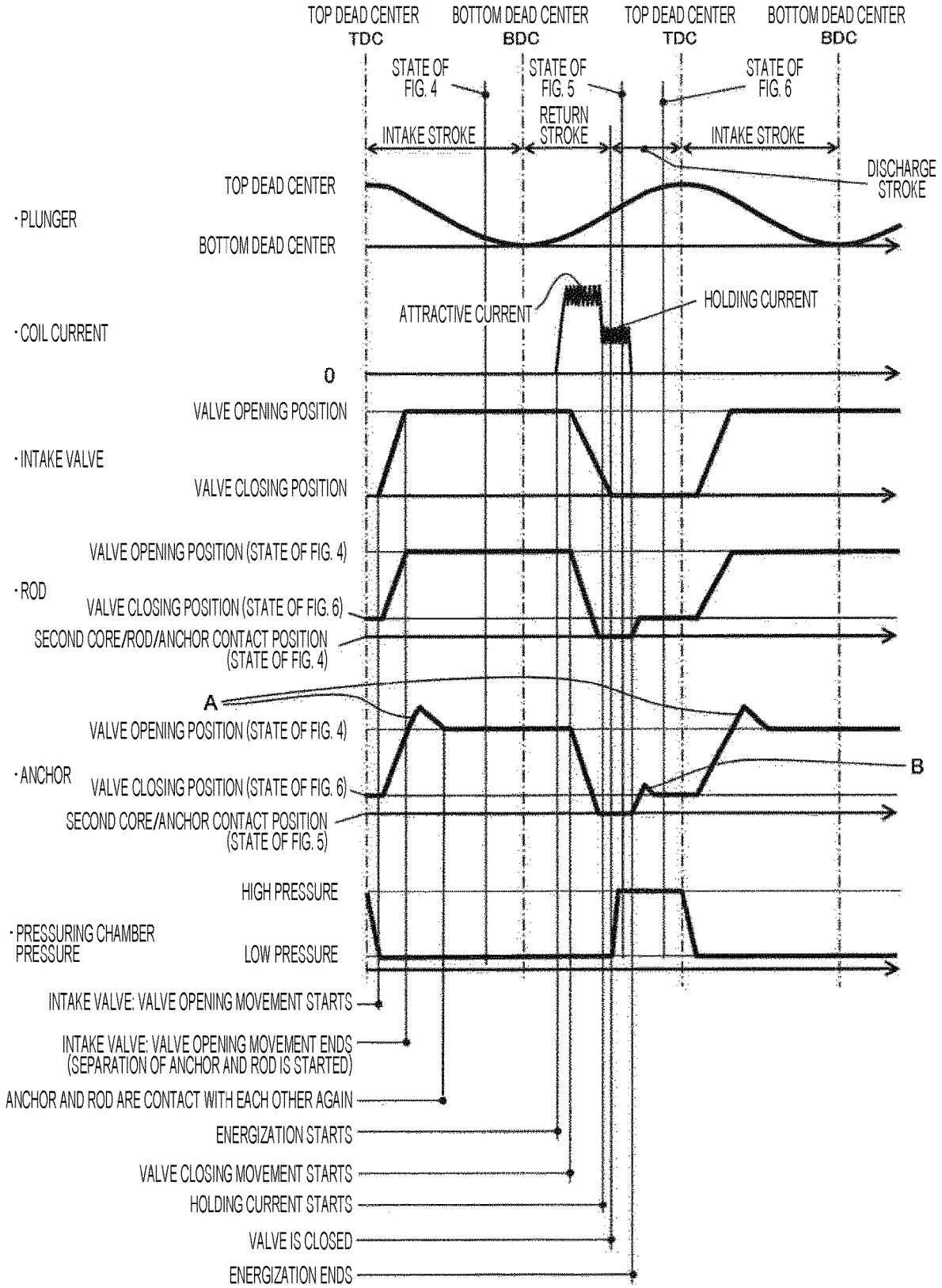
FIG. 7 is a timing chart showing operations of the plunger and the electromagnetic intake valve of the high-pressure fuel supply pump according to the first embodiment of the present invention.

Hereinafter, the operation and effect of the electromagnetic intake valve 300 will be described in detail with reference to FIGS. 4 to 6 and FIG. 7. FIG. 7 is a timing chart showing operations of the plunger and the electromagnetic intake valve of the high-pressure fuel supply pump according to the first embodiment of the present invention.

<<Intake Stroke >>

When the plunger 2 starts to descend from the top dead center, the pressure in the pressurizing chamber 11 suddenly decreases from a high-pressure state at, for example, a 20-MPa level, and the rod 35, the anchor 36, and the intake valve 30 are caused to start movement in the valve opening direction of the intake valve 30 by the force f1 described above. When the intake valve 30 is opened, the fuel that has flowed into the inner diameter side of the intake valve seat member 31 from the path 31*b* of the intake valve seat member 31 starts to be sucked into the pressurizing chamber 11.

The intake valve 30 collides with the intake valve stopper 32, and the intake valve 30 stops at that position. Similarly, the rod 35 also stops at the position where the tip contacts the intake valve 30 (a valve opening position of the rod in FIG. 7).

The anchor 36 also moves in the valve opening direction of the intake valve 30 at the same speed as that of the rod 35. However, as shown by A of FIG. 7, even after the rod 35 comes into contact with the intake valve 30 and stops, the anchor 36 tends to continue to move in the valve opening direction by an inertial force. However, the anchor biasing spring 41 overcomes the inertial force, the anchor 36 moves again in the direction of approaching the second core 39, and can stop at the position where the anchor 36 contacts the rod collar portion 35*a* (anchor valve opening position in FIG. 7). The positions of the anchor 36, the rod 35, and the intake valve 30 at this time point are the positions illustrated in FIG. 3.

In FIG. 7, the rod 35 and the anchor 36 are completely separated from each other at a portion indicated by A. However, the rod 35 and the anchor 36 may be kept in contact with each other. In other words, the load acting on the contact portion between the rod collar portion 35*a* and the anchor 36 decreases after the movement of the rod 35 stops, and when the load becomes 0, the anchor 36 starts separating from the rod 35. However, the biasing force of the anchor biasing spring 41 may be set so that the load does not become 0 and is slightly left.

When the intake valve 30 collides with the intake valve stopper 32, a problem of abnormal noise that is an important characteristic of the product occurs. The loudness of the abnormal noise is related to a level of the energy at the time of collision. In the present embodiment, since the rod 35 and the anchor 36 are configured separately, the energy of the intake valve 30 colliding with the intake valve stopper 32 is related only to the mass of the intake valve 30 and the mass of the rod 35. That is, since the mass of the anchor 36 does not contribute to the collision energy, the abnormal noise is reduced by configuring the rod 35 and the anchor 36 separately.

Even if the rod 35 and the anchor 36 are configured separately, in a case where the configuration does not include the anchor biasing spring 41, the anchor 36 continues to move in the valve opening direction of the intake valve 30 by the inertial force, and collides with the guide portion (central bearing portion) 37*b* of the rod guide 37, which causes a problem that abnormal noise is generated in a portion different from the collision portion described above. In addition to the problem of abnormal noise, the collision causes not only wear, deformation, and the like of the anchor 36 and the rod guide 37, but also a metal foreign matter due to wear. There is a risk that the function of the electromagnetic intake valve (intake valve solenoid mechanism) 300 is impaired by the metal foreign matter being sandwiched between the sliding portion and the seat portion, and the guide portion 37*b* of the rod guide 37 being deformed and impairing the bearing function.

Further, in a case of the configuration without the anchor biasing spring 41, the anchor 36 is too much separated from the second core 39 due to the inertial force (the portion A in FIG. 7). For this reason, when current is applied to the electromagnetic coil 43 in order to make a transition from the return stroke, which is a later stroke in terms of operation time, to the discharge stroke, a problem that a necessary electromagnetic attractive force cannot be obtained occurs. In a case where the necessary electromagnetic attractive force cannot be obtained, the fuel discharged from the high-pressure pump 1 cannot be controlled to a desired flow rate, which is a serious problem. For this reason, the anchor biasing spring 41 has an important function for preventing the above-described problem from occurring.

After the intake valve 30 is opened, the plunger 2 further descends and reaches the bottom dead center. During this time, fuel continues to flow into the pressurizing chamber 11. This stroke is the intake stroke.

<<Return Stroke >>

That plunger 2 that descends to the bottom dead center starts the upward stroke. The intake valve 30 remains stopped in the opened state by the force of f1, and the direction of the fluid passing through the intake valve 30 is reversed. That is, in the intake stroke, the fuel flows from the intake valve seat path 31*b* into the pressurizing chamber 11. In contrast, at the time of the upward stroke, the fuel is returned from the pressurizing chamber 11 toward the intake valve seat path 31*b*. This stroke is called the return stroke.

In this return stroke, a valve closing force of the intake valve 30 due to the returned fluid increases and the force f1 decreases, under the condition where the engine is rotated at high speed, that is, the upward speed of the plunger 2 is high in this return stroke. Under this condition, in a case where each spring force is set by mistake and f1 becomes a negative value, the intake valve 30 is unintentionally closed. Since discharge is performed at a flow rate larger than the desired discharge flow rate, the pressure in the fuel pipe is increased to the desired pressure or more, which adversely affects combustion control of the engine. For this reason, each spring force needs to be set so that the force f1 maintains a positive value under the condition where the upward speed of the plunger 2 is the highest.

<<Transition State from Return Stroke to Discharge Stroke >>

Current is applied to the electromagnetic coil 43 at a time earlier than the desired discharge time in consideration of a delay in generation of an electromagnetic force and a delay in closing of the intake valve 30, and a magnetic attractive force is generated between the anchor 36 and the second core 39. The current applied needs to be as large as necessary to overcome the force f1. At the time point this magnetic attractive force overcomes the force f1, the anchor 36 starts moving toward the second core 39. As the anchor 36 moves, the rod 35 in contact with the anchor 36 at the flange portion 35*a* in the axial direction also moves, and closing of the intake valve 30 is started by the force of the intake valve biasing spring 33 and a fluid force, mainly lowering in static pressure due to a flow rate of a fluid passing through the intake valve seat portion 31*a* from the pressurizing chamber 11 side.

When current is applied to the electromagnetic coil 43, in a case where the anchor 36 and the second core 39 are too much separated from each other by more than a specified distance, that is, in a case where the anchor 36 moves beyond the "valve opening position" in FIG. 7 and the state of A continues, the magnetic attractive force is weak and cannot overcome the force f1, and a problem that the anchor 36 requires a longtime to move to the second core 39 side or cannot move occurs.

In order to avoid this problem, the anchor biasing spring 41 is provided. In a case where the anchor 36 cannot move to the second core 39 side at a desired timing, the intake valve 30 keeps the state of being opened even at the timing of discharge, and the discharge stroke cannot be started. That is, there is a concern that desired engine combustion cannot be performed because a necessary discharge amount cannot be obtained.

For this reason, the anchor biasing spring 41 has an important function for preventing an abnormal noise problem that may occur during the intake stroke and for preventing a problem that the discharge stroke cannot be started.

The intake valve 30 that starts to move collides with the intake valve seat portion 31*a* and stops so as to be in a closed state. When the valve is closed, the in-cylinder pressure rapidly increases. Therefore, the intake valve 30 is firmly pressed by a force far larger than the force f1 in the valve closing direction due to the in-cylinder pressure, and starts to maintain the valve-closed state.

Here, the problem of erosion that may occur in the solenoid mechanism portion, which is the problem of the present embodiment, will be described.

When current is applied to the electromagnetic coil 43 and the anchor 36 is attracted to the second core 39, the space volume (gap Gp in FIG. 4) between the two objects is rapidly reduced, so that the fluid (fuel) in the space has nowhere to go. Therefore, the fluid is swept to the outer peripheral side of the anchor 36 at a large velocity and collides with the thin portion of the second core 39 (that is, the thin portion of the member surrounding the gap Gp between the anchor 36 and the second core 39). The thin portion of the member surrounding the gap Gp may be eroded due to the energy of the fluid that collides with the thin portion. Further, the swept fluid passes through the outer periphery of the anchor 36 and flows toward the rod guide 37 side. The flow rate increases because the path on the outer peripheral side of the anchor 36 is narrow. Then, cavitation due to a rapid decrease in static pressure occurs, and cavitation erosion may occur in the thin portion of the first core 38.

In order to avoid these problems, one or more of the axial through-holes 36*a* are provided on the center side of the anchor 36. This is because when the anchor 36 is attracted to the second core 39 side, the fluid in the space is caused to pass through the through-hole 36*a* so as not to pass through the narrow path on the outer periphery side of the anchor as much as possible.

Furthermore, in the present embodiment, other means are taken in order to reduce the occurrence of cavitation that causes this cavitation erosion. Since the flow is linear at a location where the fuel path is narrow and the flow rate of fuel is high, separation is likely to occur in a channel shape having a steep angle, the pressure is lowered, and cavitation is likely to occur. Therefore, by gradually widening the channel from the narrow fuel path, the flow rate is gradually lowered and the pressure drop can be suppressed. In this manner, the problem of the erosion can be solved.

When the anchor 36 and the rod 35 are integrally configured, an event that further concerns the above problem occurs. When the engine is rotating at high speed, that is, under the condition where an upward speed of the plunger 2 is high, to a force of moving the anchor 36 to the second core 39 when current is applied to the electromagnetic coil 43, a force of a fluid at an extremely high speed closing the intake valve 30 is added as an additional applied force. In this case, since the rod 35 and the anchor 36 rapidly approach the second core 39, the speed at which the fluid in the space is pushed out is further increased, and the problem of erosion becomes further larger. In a case where the capacity of the through-hole 36*a* of the anchor 36 is insufficient, there is a possibility that the problem of erosion cannot be solved.

In the present embodiment, since the anchor 36 and the rod 35 are configured separately, even in a case where a force for closing the intake valve 30 is applied to the rod 35, only the rod 35 is pushed out to the second core 39 side, and moved toward the second core 39 by a force of only a normal electromagnetic attractive force while the anchor 36 is left behind. That is, rapid space reduction does not occur and the occurrence of the erosion problem can be prevented.

As described above, the adverse effect of configuring the anchor 36 and the rod 35 separately is the problem that the desired magnetic attractive force cannot be obtained, abnormal noise, and functional degradation. However, by installing the anchor biasing spring 41, the adverse effect can be eliminated.

<<Discharge Stroke >>

When the plunger 2 makes a transition from the bottom dead center to the upward stroke and current is applied to the electromagnetic coil 43 at a desired timing, the intake valve 30 is closed and the return stroke is completed. Immediately after the return stroke is completed, the pressure in the pressurizing chamber 11 rapidly increases, and the discharge stroke is started. Since the power given to the electromagnetic coil 43 is desirably reduced from the viewpoint of power saving after a transition is made to the discharge stroke, the current given to the electromagnetic coil 43 is cut off. The electromagnetic force is no longer applied, and the anchor 36 and the rod 35 move in a direction from the second core 39 by a resultant force (FS40–FS41) of the rod biasing spring 40 and the anchor biasing spring 41. However, since the intake valve 30 is in the closed position with a strong closing force, the rod 35 stops at a position where the rod 35 collides with the intake valve 30 in the closed state. That is, the movement amount of the rod at this time is 36*e*-30*e*.

In this way, the discharge stroke in which the fuel is discharged is performed, and, immediately before the next intake stroke, the intake valve 30, the rod 35, and the anchor 36 are in the state shown in FIG. 6.

At the time point the plunger reaches the top dead center, the discharge stroke ends and the intake stroke starts again.

Thus, a necessary amount of fuel guided to the low-pressure fuel intake port 10*a* is pressurized to a high pressure by reciprocation of the plunger 2 in the pressurizing chamber 11 of the pump main body 1, and pumped to the common rail 23 from the fuel discharge port 12.

Figure 8:
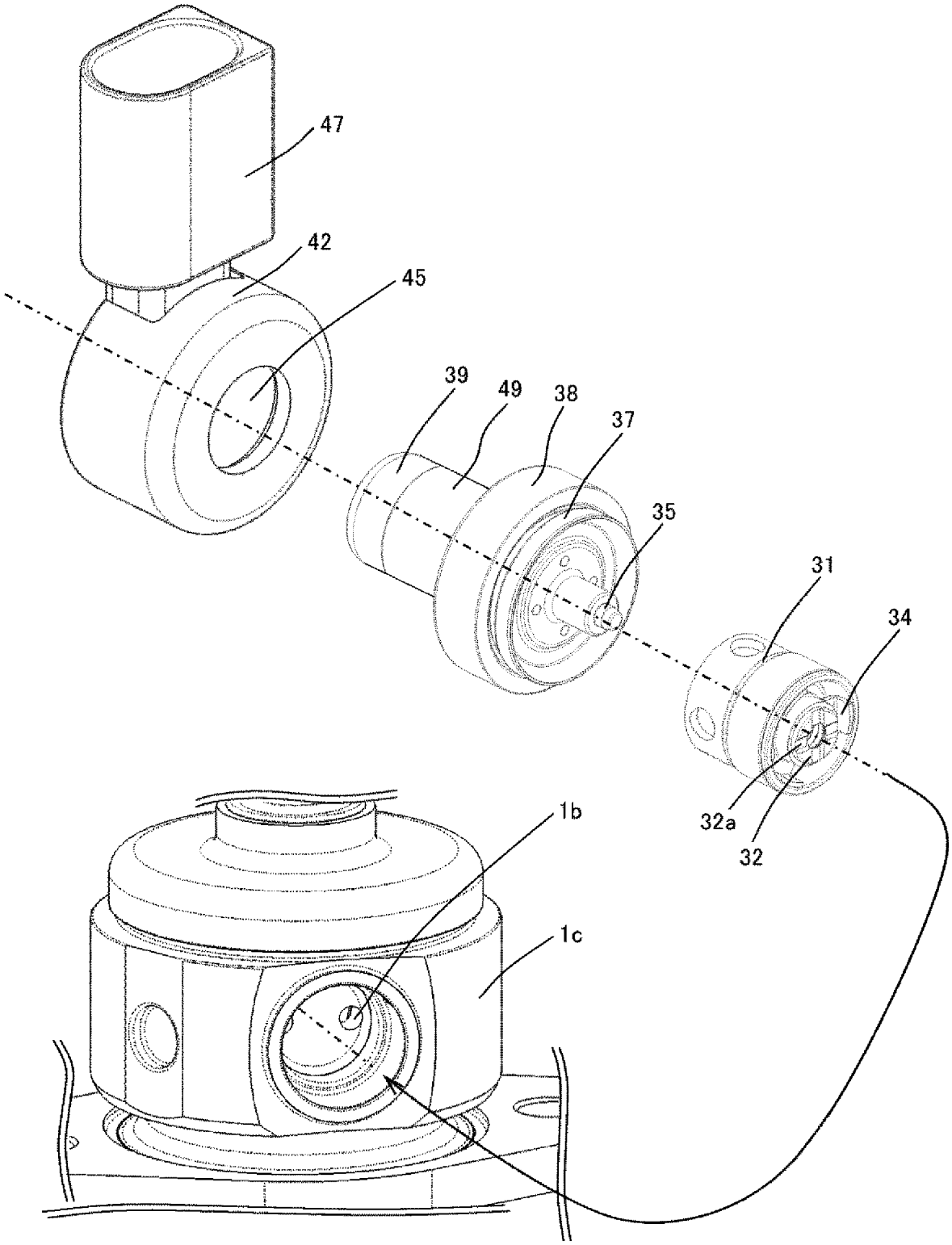
FIG. 8 is an exploded perspective view of the electromagnetic intake valve of the high-pressure fuel supply pump according to the first embodiment of the present invention.

FIG. 8 is an exploded perspective view of the electromagnetic intake valve of the high-pressure fuel supply pump according to the first embodiment of the present invention.

The high-pressure pump 1 of the present embodiment is configured by assembling the above-described components as shown in FIG. 8.

Figure 9:
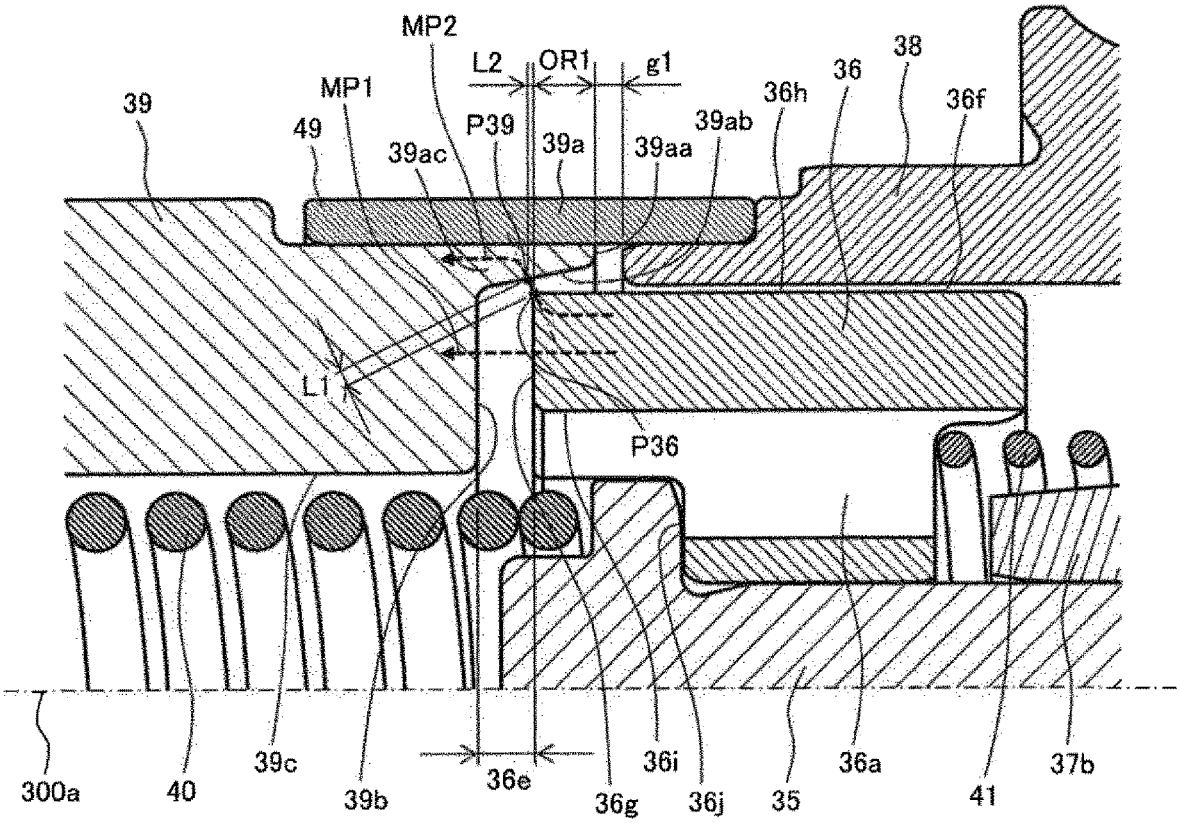
FIG. 9 is a cross-sectional view showing a collision portion between a second core and an anchor of the electromagnetic intake valve according to the first embodiment of the present invention, and shows a state when the electromagnetic intake valve is de-energized and opened.

FIG. 9 is a cross-sectional view showing a collision portion between the second core and the anchor of the electromagnetic intake valve according to the first embodiment of the present invention, and shows a state when the electromagnetic intake valve is de-energized and opened.

In the high-pressure pump 1 of the present embodiment, as shown in FIG. 9, the second core 39 has a protrusion 39*a*. The protrusion 39*a* is located on the radially outer side of the outer periphery of the anchor facing surface 36*g*, and protrudes from the second core facing surface 39*b* along a central axis 300*a* of the electromagnetic intake valve 300 so as to protrude toward the anchor 36. Further, the protrusion 39*a* is formed in an annular shape in a circumferential direction of the second core facing surface 39*b*.

In the present embodiment, the protrusion 39*a* has a trapezoidal shape in the cross section shown in FIG. 9. That is, the protrusion 39*a* has a larger width (thickness) dimension of a connecting portion (base side end portion) 39*ac* to the second core facing surface 39*b* than a width (thickness) dimension of a tip end portion 39*aa* in the protruding direction, and an inner peripheral surface 39*ab* is inclined with respect to the central axis 300*a*. The inner peripheral surface 39*ab* is configured as an inclined surface (tapered surface) that increases in diameter from the base side end portion 39*ac* side toward the tip end portion 39*aa* side. In other words, the inner peripheral surface 39*ab* is configured as an inclined surface (tapered surface) that reduces in diameter from the tip end portion 39*aa* side toward the base side end portion 39*ac* side.

In particular, in the present embodiment, the tip end portion 39*aa* of the protrusion 39*a* is positioned on the intake valve 30 side with respect to the anchor facing surface 36*g*, and the inner peripheral surface 39*ab* covers the outer periphery side of part of an outer peripheral surface 36*h* of the anchor 36 on the anchor facing surface 36*g* side. That is, the protrusion 39*a* is provided in a range overlapping with the outer peripheral surface 36*h* of the anchor 36 in a range indicated by OR1 from the anchor facing surface 36*g* toward the intake valve 30 side in a direction along the central axis 300*a*, and is provided at a position (on the radially outer side) separated from the outer peripheral surface 36*h* of the anchor 36.

The protrusion 39*a* is characterized by having a configuration, in which a minimum distance (shortest distance) L1 formed between the protrusion 39*a* and the anchor facing surface 36*g* is small as compared to an axial gap dimension 36*e* between the second core facing surface 39*b* and the anchor facing surface 36*g* in a state where the anchor 36 is stationary when the electromagnetic coil 43 is not energized. Further, in the present embodiment, a point (position) P39 on the second core 39 side and a point (position) P36 on the anchor 36 side forming the minimum distance L1 are configured in such a manner that the point P39 on the second core 39 side is positioned closer to the second core facing surface 39*b* side than the point P36 on the anchor 36 side in the direction along the central axis 300*a*.

In the present embodiment, the anchor facing surface 36*g* is formed perpendicular to the central axis 300*a*, and the point P36 on the anchor 36 side where the distance between the protrusion 39*a* and the anchor facing surface 36*g* is the shortest is positioned on the outer periphery of the anchor facing surface 36*g*. Note that the central axis 300*a* is an axis along the valve opening and closing direction of the intake valve 30 and coincides with the central axes of the rod 35, the anchor 36, and the second core 39.

Figure 10:
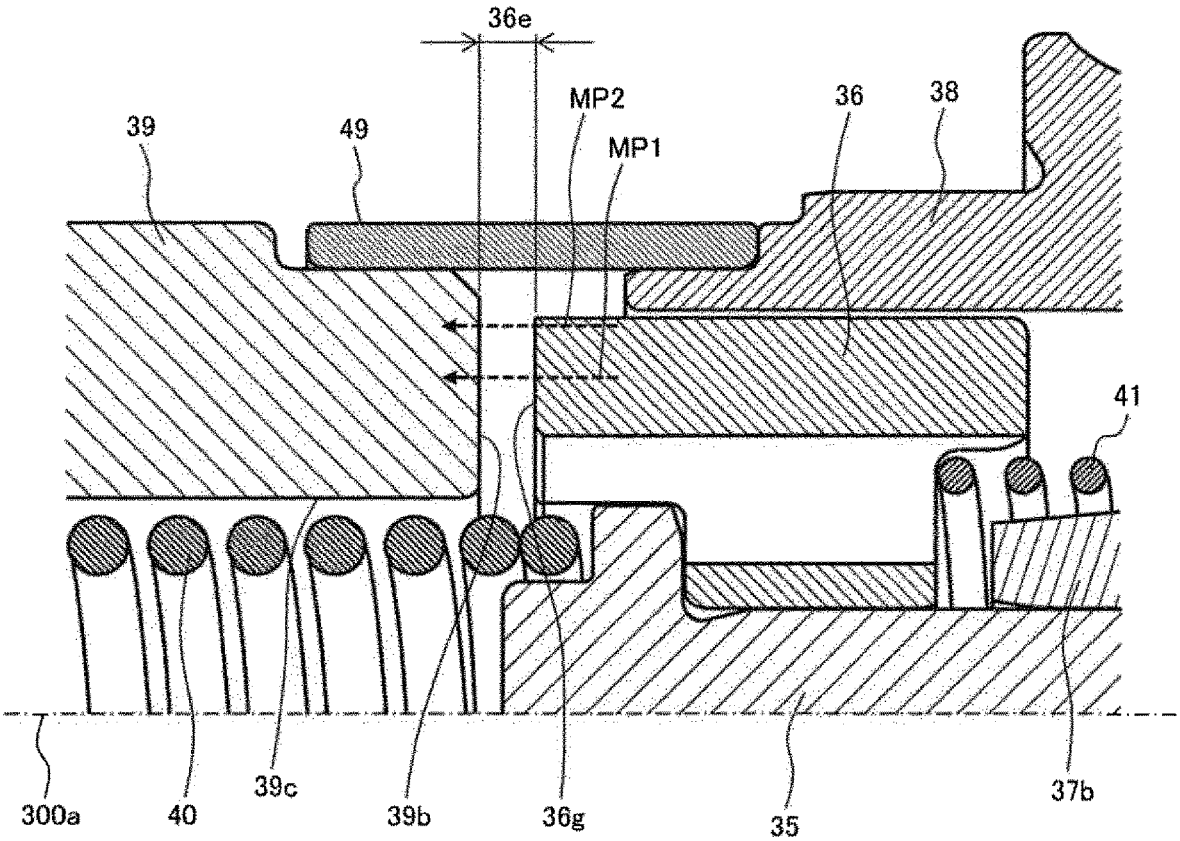
FIG. 10 is a cross-sectional view showing the collision portion between the second core and the anchor of the electromagnetic intake valve according to a comparative example of the present invention, and shows a state when the electromagnetic intake valve is de-energized and opened.

FIG. 10 is a cross-sectional view showing the collision portion between the second core and the anchor of the electromagnetic intake valve according to a comparative example of the present invention, and shows a state when the electromagnetic intake valve is de-energized and opened.

In the comparative example of FIG. 10, cavitation is more likely to occur than in the present embodiment. The reason for this will be explained. FIG. 10 shows a fuel path in the anchor 36. By energizing the electromagnetic coil 43, a magnetic attractive force is generated between the anchor 36 and the second core 39, and the anchor 36 and the rod 35 move to the second core 39 side. In this manner, a fluid is pushed out and flows toward the intake valve 30 through the combustion path 36*a*. At that time, flow is generated also from a side gap portion 36*f* on the outer peripheral portion of the anchor 36 toward the intake valve 30 side. However, cavitation is likely to occur due to a rapid pressure drop due to the jet caused by the collision between the second core 39 and the anchor 36.

In the comparative example of FIG. 10, the paths of the magnetic flux are not different between the inner peripheral side and the outer peripheral side of the anchor facing surface 36*g*, as indicated by MP1 (first magnetic flux path) and MP2 (second magnetic flux path). There are only the paths passing through the axial gap dimension 36*e* between the second core facing surface 39*b* and the anchor facing surface 36*g*.

On the other hand, in the present embodiment, as shown in FIG. 9, the path MP1 of the magnetic flux passing on the inner peripheral side of the anchor facing surface 36*g* passes through the axial gap dimension 36*e* between the second core facing surface 39*b* and the anchor facing surface 36*g*, while the path MP2 of the magnetic flux passing through the minimum distance L1 between the protrusion 39*a* and the anchor facing surface 36*g* is formed on the outer peripheral side of the anchor facing surface 36*g*.

That is, the paths of the magnetic flux in the comparative example are in one direction, whereas the paths of the magnetic flux in the present embodiment are in two directions. For this reason, when the second core 39 and the anchor 36 collide, the magnetic attractive force generated in the axial direction is reduced. In this manner, the collision speed of the anchor 36 with respect to the second core 39 is reduced, and cavitation erosion can be suppressed.

Figure 11:
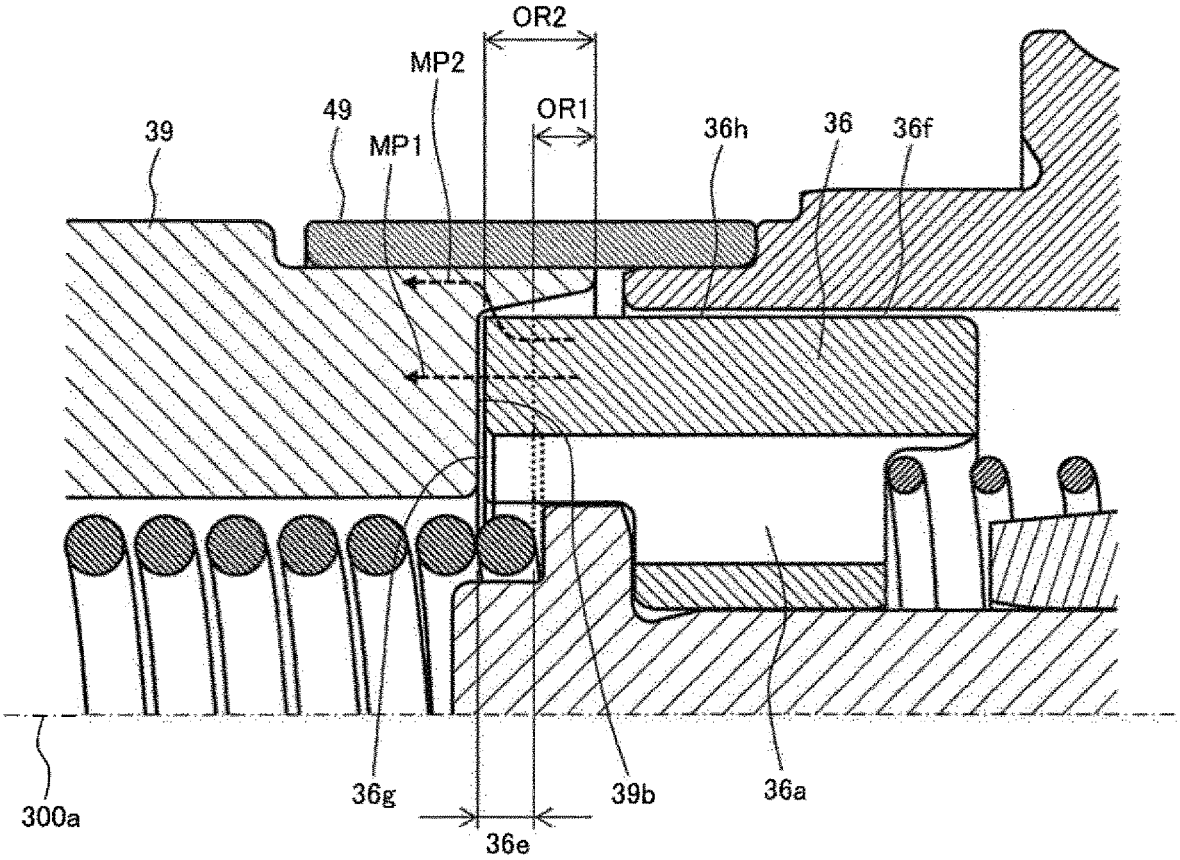
FIG. 11 is a cross-sectional view showing the collision portion between the second core and the anchor of the electromagnetic intake valve according to the first embodiment of the present invention, and shows a state immediately before the second core and the anchor collide with each other after the electromagnetic intake valve is energized.

FIG. 11 is a cross-sectional view showing the collision portion between the second core and the anchor of the electromagnetic intake valve according to the first embodiment of the present invention, and shows a state immediately before the second core and the anchor collide with each other after the electromagnetic intake valve is energized. Note that, in FIG. 11, the position of the anchor 36 in a stationary state at the time of non-energization (the position of the anchor 36 in FIG. 9) is indicated by a dotted line.

In the present embodiment, as shown in FIG. 11, as the anchor 36 approaches the second core 39, the range where the inner peripheral surface 39*ab* of the protrusion 39*a* overlaps the outer peripheral surface 36*h* of the anchor 36 in the direction along the central axis 300*a* expands from OR1 to OR2.

In this manner, as the anchor 36 approaches the second core 39, the magnetic flux (magnetic flux passing on the MP2 side) flowing from the anchor 36 to the protrusion 39*a* increases more and more. Further, the inner peripheral surface 39*ab* of the protrusion 39*a* is configured as an inclined surface, and the distance between the anchor 36 and the protrusion 39*a* becomes shorter as the anchor 36 approaches the second core 39. In this manner, as the anchor 36 approaches the second core 39, the magnetic flux (magnetic flux passing on the MP2 side) flowing from the anchor 36 to the protrusion 39*a* increases more and more. For this reason, when the second core 39 and the anchor 36 collide, the magnetic attractive force generated in the axial direction is reduced more and more.

Further, in the present embodiment, when the electromagnetic coil 43 is energized from the state shown in FIG. 9, the rising of the magnetic flux passing through MP2 is fast since the gap distance L1 of the path MP2 of the magnetic flux is shorter than the gap distance 36*e*. Furthermore, the point P39 on the second core 39 side through which MP2 passes is configured to be positioned closer to the second core facing surface 39*b* side than the point P36 on the anchor 36 side. In this manner, the magnetic flux passing through MP2 causes the magnetic attraction force for attracting to the second core 39 side to act on the anchor 36.

For this reason, in the present embodiment, the movement start speed of the anchor 36 can be increased, and the valve closing responsiveness can be improved.

Further, the protrusion 39*a* of the second core 39 is configured to be positioned on the radially outer side of the second core facing surface 39*b*. In this manner, a high-pressure portion formed by the jet accompanying the collision between the second core 39 and the anchor 36 can be moved away from a generation position of cavitation caused by the collision between the second core 39 and the anchor 36. In this manner, rapid pressure recovery of cavitation can be avoided and erosion can be reduced.

Further, the inner peripheral surface 39*ab* of the protrusion 39*a* of the second core 39 is inclined in such a manner that the tip end portion 39*aa* side is closer to the radially outer side (outer peripheral surface side) than the second core facing surface 39*b* side.

That is, the protrusion 39*a* of the second core 39 is configured to have a tapered shape. In this manner, since the channel area is gradually enlarged toward the intake valve 30 side, the flow rate of the jet accompanying the collision between the second core 39 and the anchor 36 can be reduced. For this reason, rapid pressure recovery of cavitation can be avoided and erosion can be reduced.

Further, in a state where the electromagnetic coil 43 is not energized, the anchor 36 is configured to be at a position far away from the second core 39 (position that is separated by the axial gap dimension 36*e*). In this manner, power consumption can be reduced compared to a structure that closes the valve when not energized and opens the valve when energized.

Further, in a state where the electromagnetic coil 43 is not energized, the anchor 36 is configured to be at a position far away from the second core 39 (position that is separated by the axial gap dimension 36*e*) by being biased by the rod biasing spring 40 in the valve opening direction. In this manner, power consumption can be reduced compared to a structure that closes the valve when not energized and opens the valve when energized.

Second Embodiment

Figure 12:
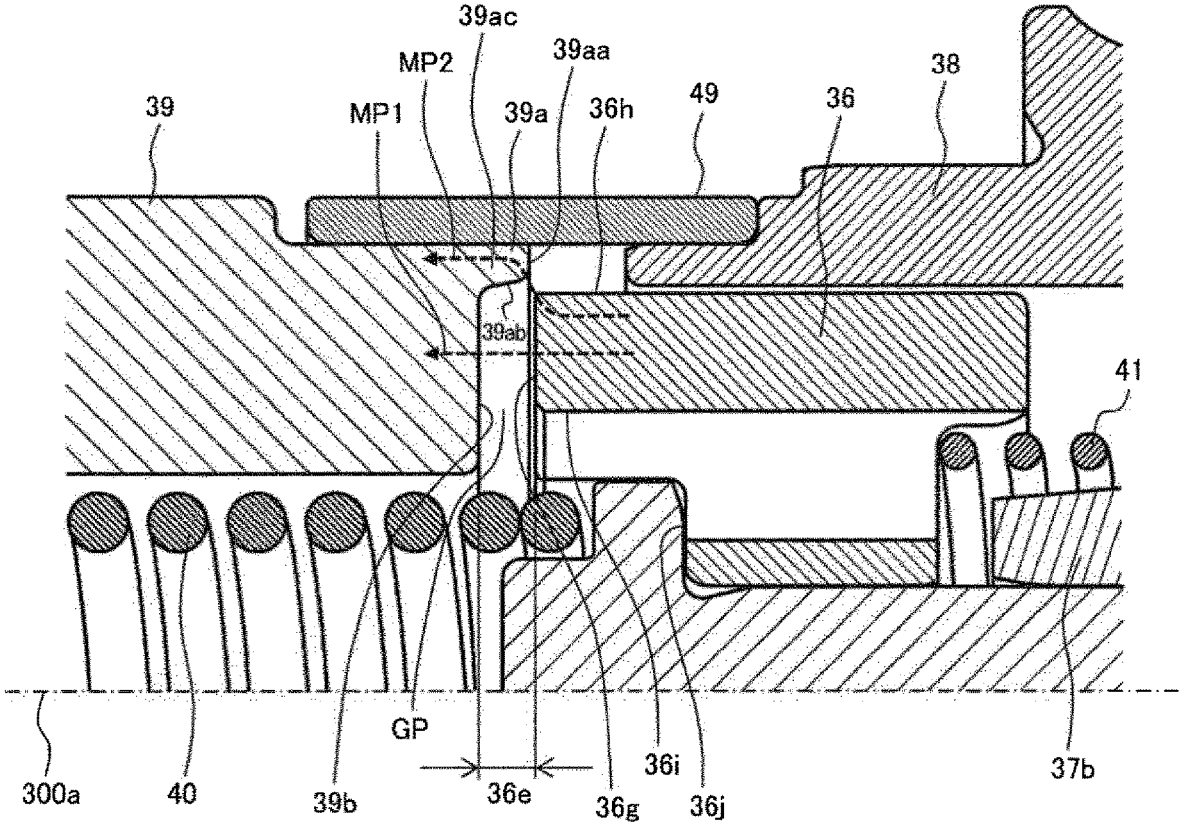
FIG. 12 is a cross-sectional view showing the collision portion between the second core and the anchor of the electromagnetic intake valve according to a second embodiment of the present invention, and shows a state when the electromagnetic intake valve is de-energized and opened.

FIG. 12 is a cross-sectional view showing a collision portion between the second core and the anchor of the electromagnetic intake valve according to a second embodiment of the present invention, and shows a state when the electromagnetic intake valve is de-energized and opened. That is, FIG. 12 is a diagram showing a state similar to that in FIG. 9.

In the present embodiment, the tip end portion 39*aa* of the protrusion 39*a* is configured to be located at the same position as that of the anchor facing surface 36*g* or closer to the second core facing surface 39*a* side than the anchor facing surface 36*g* in the direction along the central axis 300*a*. That is, the inner peripheral surface 39*ab* of the protrusion 39*a* is provided on the outer peripheral side of the gap Gp constituting the axial gap dimension 36*e*, and is not provided on the side of the outer peripheral surface 36*h* of the anchor 36.

Also in the present embodiment, in addition to the magnetic flux path MP1 (first magnetic flux path), the magnetic flux path MP2 (second magnetic flux path) similar to that in the first embodiment is configured, and an effect similar to that of the first embodiment is obtained.

Figure 13:
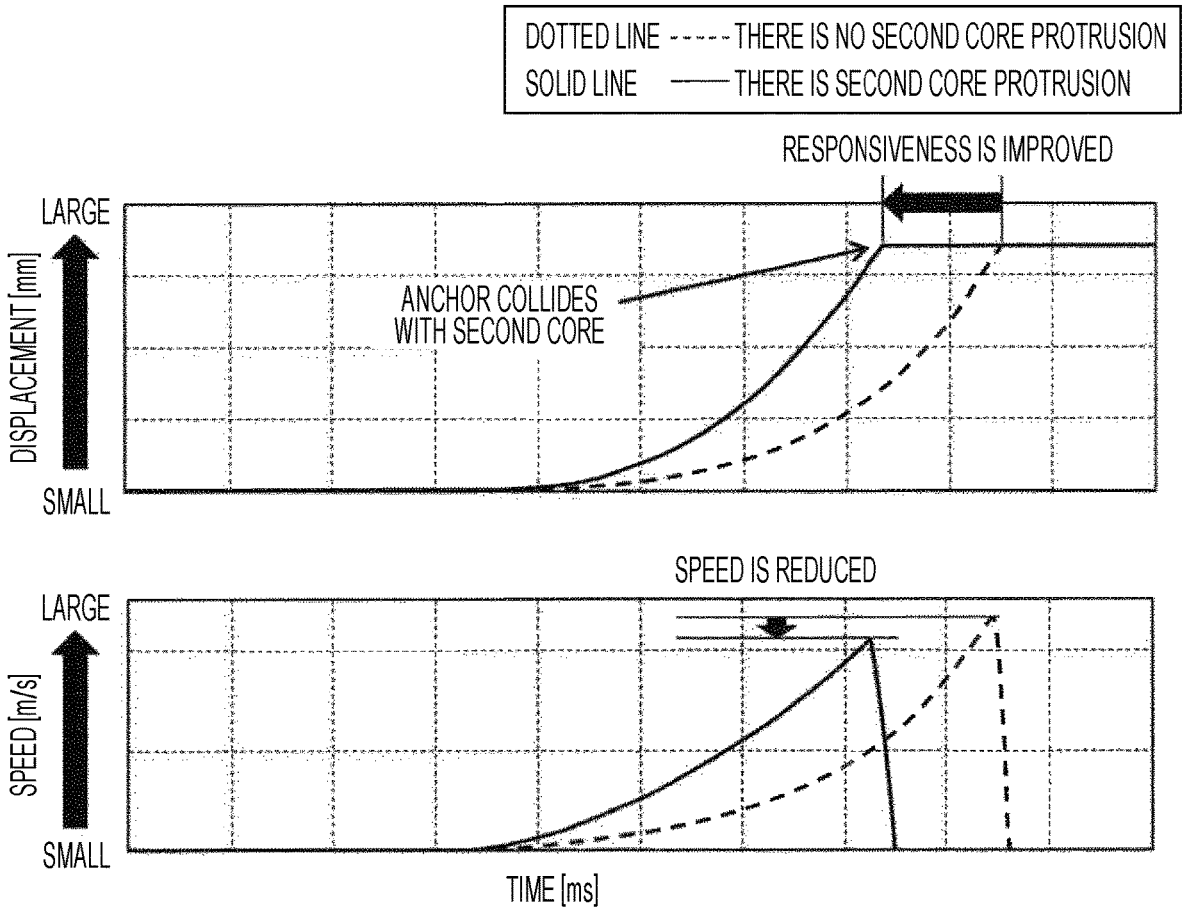
FIG. 13 is a diagram showing an analysis result of displacement and speed of the anchor of the electromagnetic intake valve according to the second embodiment of the present invention.

FIG. 13 is a diagram showing an analysis result of displacement and speed of the anchor of the electromagnetic intake valve according to the second embodiment of the present invention.

FIG. 13 shows an analysis result for the displacement of the anchor 36 and the moving speed (hereinafter referred to as speed) of the anchor 36 for a case of the anchor 36 having the protrusion 39*a* on the second core 39 and a case of the anchor 36 not having the protrusion 39*a* on the second core 39. Note that this analysis result is a result of analysis performed for the protrusion 39*a* of the second embodiment. According to this analysis result, as compared to the case where the protrusion 39*a* is not present, the rising of the speed of the anchor 36 is quick after energization is started in the case where the protrusion 39*a* is present, and the timing at which the anchor 36 collides with the second core 39 is also accelerated. This shows that the responsiveness of the anchor 36 is improved. This is considered to happen because a magnetic flux that flows in the magnetic path MP2 with a short gap length rises quickly as there are two magnetic flux paths MP1 and MP2, and this magnetic flux causes a magnetic attractive force attracting to the second core 39 side to act on the anchor 36.

Further, the analysis result also shows that the maximum value of the moving speed is small in the case where the protrusion 39*a* is present as compared to the case where the protrusion 39*a* is not present, and the collision speed of the anchor 36 with the second core 39 is reduced. This is considered to happen because the magnetic attractive force acting on the anchor 36 in the direction (axial direction) along the central axis 300*a* is dispersed by two magnetic flux paths MP1 and MP2, and the maximum speed of the anchor 36 is reduced.

Third Embodiment

Figure 14:
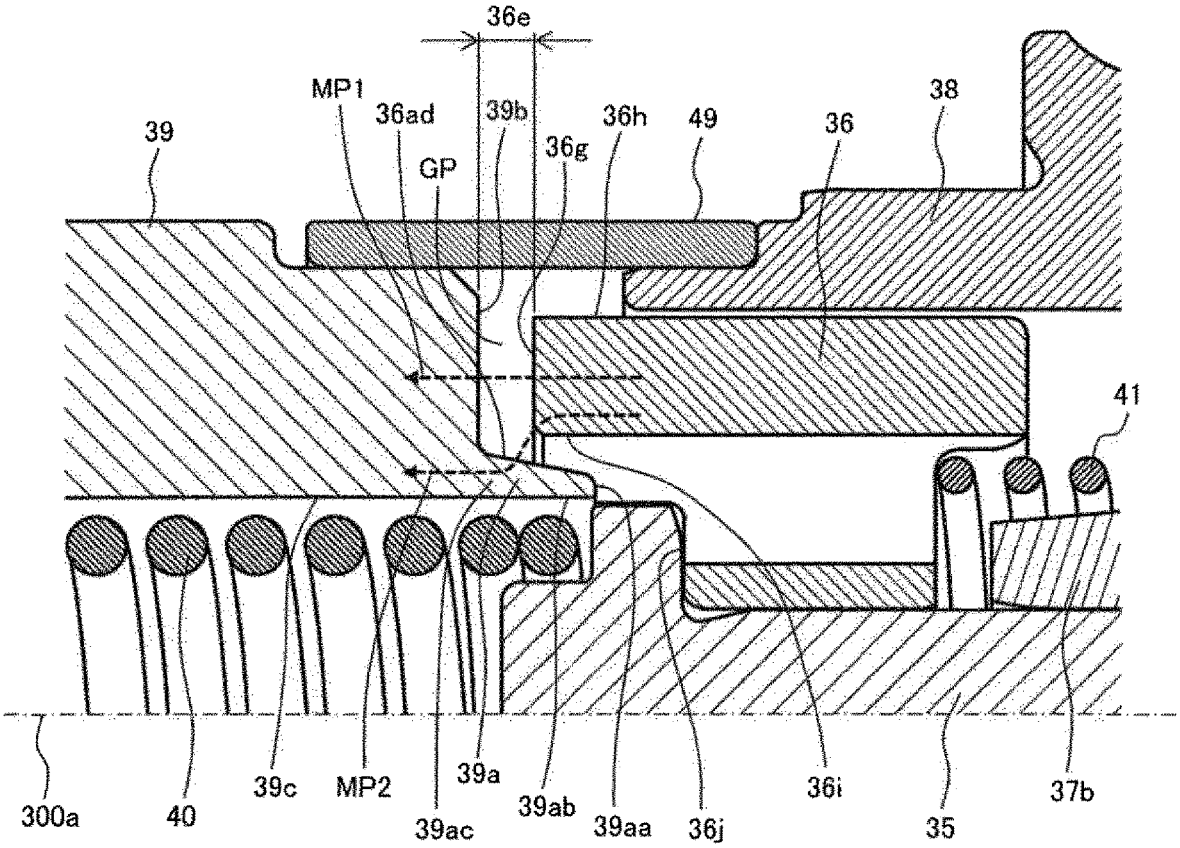
FIG. 14 is a cross-sectional view showing the collision portion between the second core and the anchor of the electromagnetic intake valve according to a third embodiment of the present invention, and shows a state when the electromagnetic intake valve is de-energized and opened.

FIG. 14 is a cross-sectional view showing a collision portion between the second core and the anchor of the electromagnetic intake valve according to a third embodiment of the present invention, and shows a state when the electromagnetic intake valve is de-energized and opened.

In the present embodiment, the protrusion 39*a* of the second core 39 is configured to be located on the radially inner side (inner peripheral side) of the second core facing surface 39*b* of the second core 39, and the inner peripheral surface 39*ab* of the protrusion 39*a* constitutes part of a through-hole 39*c* of the second core 39 in which the rod biasing spring 40 is disposed. Further, the protrusion 39*a* is inserted into an axial recess 36*j* of the anchor 36 into which the small-diameter portion 35*b* of the rod 35 is inserted, and an outer peripheral surface 39*a* d of the protrusion 39*a* faces an inner peripheral surface 36*i* of the anchor 36.

The outer peripheral surface 39*a* d is configured as an inclined surface (tapered surface) that decreases in diameter from the base side end portion 39*ac* side toward the tip end portion 39*a* a side. In other words, the outer peripheral surface 39*a* d is configured as an inclined surface (tapered surface) that increases in diameter from the tip end portion 39*aa* side toward the base side end portion 39*ac* side.

In the present embodiment, the protrusion 39*a* is disposed on the inner peripheral side of the second core facing surface 39*b*, so that arrangement of the inner peripheral surface 39*ab* and the outer peripheral surface 39*a* d of the protrusion 39*a* with respect to the anchor 36 are switched from the first embodiment and the second embodiment in which the protrusion 39*a* is disposed on the outer peripheral side of the second core facing surface 39*b*. The magnetic flux path MP2 is configured on the inner peripheral side of the second core facing surface 39*b* with respect to the magnetic flux path MP1, and passes on the outer peripheral surface 39*a* d of the protrusion 39*a*.

In this manner, two paths are formed for the magnetic flux generated between the second core 39 and the anchor 36 during energization, and the collision speed of the anchor 36 with respect to the second core 39 can be reduced, so that cavitation erosion can be reduced. In addition to the above, in the present embodiment, an effect similar to that described in the first and second embodiments can be obtained.

Further, the protrusion 39*a* of the present embodiment differs from the first embodiment in the radial arrangement with respect to the second core facing surface 39*b*, and the other configurations are similar to those in the embodiment. The configuration which is a feature of the second embodiment may be applied to the configuration of the present embodiment, and the protruding height of the protrusion 39*a* may be lowered. That is, the outer peripheral surface 39*a* d of the protrusion 39*a* may be provided in the axial range of the gap Gp constituting the axial gap dimension 36*e* and not provided on the inner peripheral side of the inner peripheral surface 36*i* of the anchor 36.

The inner peripheral surface 39*ab* of the protrusion 39*a* of the first and second embodiments and the outer peripheral surface 39*a* d of the protrusion 39*a* of the third embodiment are surfaces extending along the central axis 300*a* of the protrusion 39*a*, and constitute a step surface between the tip end portion 39*aa* of the protrusion 39*a* and the second core facing surface 39*b* (the base side end portion 39*ac* of the tip end portion 39*aa*).

In the above-described embodiments, the configuration in which the second core facing surface 39*b* of the second core 39 and the anchor facing surface 36*g* of the anchor 36 abut on each other is described. However, the configuration can be such that a convex portion is provided on either one of the second core facing surface 39*b* or the anchor facing surface 36*g* so that the convex portion and the second core facing surface 39*b* or the anchor facing surface 36*g* facing the convex portion abut on each other.

In this case, the axial gap dimension (movement amount of the anchor 36) 36*e* between the second core facing surface 39*b* and the anchor facing surface 36*g* becomes a gap dimension between the tip of the convex portion and the second core facing surface 39*b* or the anchor facing surface 36*g* facing the convex portion.

The second core facing surface 39*b* or the anchor facing surface 36*g* on which the convex portion is provided is a facing surface constituting an abutting portion abutting on the second core facing surface 39*b* or the anchor facing surface 36*g* facing the convex portion. Further, in the configuration in which the second core facing surface 39*b* and the anchor facing surface 36*g* directly abut on each other, the second core facing surface 39*b* and the anchor facing surface 36*g* are facing surfaces that constitute abutting portions that abut on each other. In the state where the abutting portions of the second core 39 and the anchor 36 abut on each other, the protrusion 39*a* formed on the outer peripheral portion or the inner peripheral portion of the second core facing surface 39*b* is not in contact with the anchor 36, and is located radially outward with respect to the outer peripheral surface 36*h* of the anchor 36 or radially inward with respect to the inner peripheral surface 36*i* of the anchor 36.

According to each embodiment of the present invention, effects, such as improved responsiveness achieved by increasing the anchor movement start speed, the suppression of cavitation erosion by reducing the maximum anchor movement speed, and also reduction of the collision energy between the fixed core 39 and the anchor 36 can be brought about.

Note that the present invention is not limited to the above embodiments and includes a variety of variations. For example, the above embodiments are described in detail for easy understanding of the present invention, and the present invention is not necessarily limited to embodiments that include all the configurations. Further, part of a configuration of a certain embodiment can be replaced with a configuration of another embodiment, and a configuration of a certain embodiment can also be added to a configuration of another embodiment. For part of a configuration of each embodiment, other configurations may be added, removed, or replaced.

REFERENCE SIGNS LIST

1 pump main body
2 plunger
6 cylinder
7 seal holder
8 discharge valve mechanism
9 pressure pulsation reduction mechanism
10*a* low-pressure fuel intake port
11 pressurizing chamber
12 fuel discharge port
13 plunger seal
30 intake valve
31 intake valve seat member
33 intake valve spring
35 rod
36 anchor (movable core)
36*a* fuel path
36*b* anchor protrusion
36*c* anchor inner peripheral portion
36*d* channel area minimum portion
36*f* fuel path (side gap portion)
36*g* anchor facing surface
38 first core (electromagnetic intake valve housing)
39 second core (fixed core)
39*a* protrusion (second core trapezoidal protrusion)
39*b* second core facing surface
40 rod biasing spring
41 anchor biasing spring
43 electromagnetic coil
48 spring space
300 electromagnetic intake valve

The invention claimed is:

1. A high-pressure fuel supply pump comprising:

an electromagnetic intake valve having a fixed core, an anchor that faces the fixed core in a direction along a central axis and is biased to a side away from the fixed core, and an electromagnetic coil, the high-pressure fuel supply pump causing a magnetic attractive force to act between a fixed core facing surface of the fixed core facing the anchor and an anchor facing surface of the anchor facing the fixed core to drive the anchor toward the fixed core and change a discharge amount of fuel as the electromagnetic coil is energized, wherein the fixed core has a protrusion protruding to the anchor side on the fixed core facing surface, in a state where the anchor is stationary when the electromagnetic coil is not energized, a minimum distance between the protrusion of the fixed core and the anchor facing surface is configured to be smaller than an axial gap dimension configured between the fixed core facing surface and the anchor facing surface in a direction along the central axis, the protrusion is located on a radially outer side with respect to an outer peripheral surface of the anchor or a radially inner side with respect to an inner peripheral surface of the anchor without contacting the anchor in a state where the anchor abuts on the fixed core when the electromagnetic coil is energized, the protrusion is formed to be positioned on an outer peripheral side of the fixed core facing surface, the anchor facing surface is formed perpendicular to the central axis, the minimum distance is configured between an outer periphery of the anchor facing surface and the protrusion, and the protrusion is formed as a tapered surface, in which an outer peripheral surface reduces in diameter front a tip end portion side in a protruding direction toward a side of the fixed core facing surface.

2. The high-pressure fuel supply pump according to claim 1, wherein the protrusion is provided so as to face an outer peripheral surface of the anchor from a radially outer side in a state where the anchor is stationary when the electromagnetic coil is not energized.

3. The high-pressure fuel supply pump according to claim 1, wherein the protrusion is formed to be positioned on an inner peripheral side of the fixed core facing surface.

4. The high-pressure fuel supply pump according to claim 1, further comprising:

a rod that is configured to be relatively displaceable in a direction along a central axis with respect to the anchor, and that is engaged with the anchor and moves toward the fixed core when the anchor moves toward the fixed core;

a rod biasing spring that biases the rod to a side away from the fixed core; and an anchor biasing spring that biases the anchor toward a side of the fixed core with a biasing force smaller than a biasing force of the rod biasing spring, wherein the anchor is biased to a side away from the fixed core via the rod by a biasing force that is a difference between a biasing force of the rod biasing spring and a biasing force of the anchor biasing spring.

* * * * *